US010768540B2

(12) United States Patent
Watanabe et al.

(10) Patent No.: US 10,768,540 B2
(45) Date of Patent: Sep. 8, 2020

(54) EXTERNAL ADDITIVE, METHOD FOR MANUFACTURING EXTERNAL ADDITIVE, AND TONER

(71) Applicant: CANON KABUSHIKI KAISHA, Tokyo (JP)

(72) Inventors: Shuntaro Watanabe, Hadano (JP); Tatsuya Saeki, Suntou-gun (JP); Atsuhiko Ohmori, Yokohama (JP); Shuhei Moribe, Mishima (JP); Hiroki Akiyama, Suntou-gun (JP); Kazumichi Nakahama, Suntou-gun (JP); Katsuhisa Yamazaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/272,254

(22) Filed: Feb. 11, 2019

(65) Prior Publication Data

US 2019/0250526 A1 Aug. 15, 2019

(30) Foreign Application Priority Data

Feb. 14, 2018 (JP) ..... 2018-023932

(51) Int. Cl.
*G03G 9/08* (2006.01)
*G03G 9/087* (2006.01)
(Continued)

(52) U.S. Cl.
CPC ..... *G03G 9/0804* (2013.01); *G03G 9/0802* (2013.01); *G03G 9/083* (2013.01);
(Continued)

(58) Field of Classification Search
CPC .. G03G 9/0804; G03G 9/08755; G03G 9/083; G03G 9/09716; G03G 9/08797;
(Continued)

(56) References Cited

U.S. PATENT DOCUMENTS 6,875,549 B2 4/2005 Yamazaki et al.
6,881,527 B2 4/2005 Moribe et al.
(Continued)

FOREIGN PATENT DOCUMENTS

JP 2004-212740 7/2004
JP 2013-083837 5/2013
(Continued)

OTHER PUBLICATIONS

U.S. Appl. No. 16/259,159, Shuntaro Watanabe, filed Jan. 28, 2019.

*Primary Examiner* — Thorl Chea
(74) *Attorney, Agent, or Firm* — Venable LLP

(57) ABSTRACT

Provided is an external additive having a resin particle containing a crystalline resin, and an inorganic fine particle containing a metal atom, the inorganic fine particle being embedded in the resin particle, wherein part of the inorganic fine particle being exposed on a surface of the resin particle, the maximum endothermic peak temperature of the external additive during a first temperature rise is from 50.0° C. to 120° C., the shape factor SF-2 of the external additive is from 110 to 150, and the external additive satisfies following formulae (1) and (2) below, in which Za (mass %) is the percentage content of a metal atom contained in the inorganic fine particle on the surface of the external additive in X-ray photoelectron spectroscopy, and Zb (mass %) is the percentage content of the metal atom in thermogravimetric analysis of the external additive, $$Za \geq 15 \quad (1), \text{ and}$$

$$Za/Zb \geq 0.7 \quad (2)$$

19 Claims, 2 Drawing Sheets

(51) Int. Cl.
*G03G 9/097* (2006.01)
*G03G 9/083* (2006.01)

(52) U.S. Cl.
CPC ..... *G03G 9/0819* (2013.01); *G03G 9/08755* (2013.01); *G03G 9/08797* (2013.01); *G03G 9/09708* (2013.01)

(58) Field of Classification Search
CPC ..... G03G 9/08795; G03G 9/09708; G03G 9/09725; G03G 9/09783
See application file for complete search history.

(56) References Cited

U.S. PATENT DOCUMENTS 7,014,969 B2 3/2006 Yachi et al.
7,267,919 B2 9/2007 Moribe et al.
7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,537,877 B2 5/2009 Yoshiba et al.
7,544,455 B2 6/2009 Yoshiba et al.
7,638,251 B2 12/2009 Yamazaki et al.
7,700,254 B2 4/2010 Moribe et al.
7,740,998 B2 6/2010 Yamazaki et al.
7,855,042 B2 12/2010 Kobori et al.
7,897,316 B2 3/2011 Yamazaki et al.
8,026,030 B2 9/2011 Moribe et al.
8,057,977 B2 11/2011 Moribe et al.
8,501,377 B2 8/2013 Takahashi et al.
8,512,925 B2 8/2013 Moribe et al.
8,603,712 B2 12/2013 Aoki et al.
8,614,044 B2 12/2013 Matsui et al.
8,741,519 B2 6/2014 Watanabe et al.
8,846,284 B2 9/2014 Kinumatsu et al.
8,883,389 B2 11/2014 Matsui et al.
9,040,216 B2 5/2015 Fukudome et al.
9,097,998 B2 8/2015 Yamazaki et al.
9,116,448 B2 8/2015 Terauchi et al.
9,128,400 B2 9/2015 Takahashi et al.
9,134,637 B2 9/2015 Hotta et al.
9,141,012 B2 9/2015 Moribe et al.
9,152,065 B2 10/2015 Sano et al.
9,201,323 B2 * 12/2015 Nishikawa ..... G03G 9/09708
9,213,250 B2 12/2015 Nomura et al.
9,213,251 B2 12/2015 Ohmori et al.
9,239,528 B2 1/2016 Hasegawa et al.
9,250,548 B2 2/2016 Nomura et al.
9,261,804 B2 2/2016 Yamazaki et al.
9,261,806 B2 2/2016 Moribe et al.
9,285,697 B2 3/2016 Fukudome et al.
9,304,422 B2 4/2016 Matsui et al.
9,309,349 B2 4/2016 Watanabe et al.
9,341,970 B2 5/2016 Yoshiba et al.
9,348,246 B2 5/2016 Magome et al.
9,354,545 B2 5/2016 Matsui et al.
9,429,860 B2 8/2016 Kinumatsu et al.
9,442,416 B2 9/2016 Magome et al.
9,470,993 B2 10/2016 Nishikawa et al.
9,575,425 B2 2/2017 Naka et al.
9,588,450 B2 3/2017 Tsuda et al.
9,606,462 B2 3/2017 Nomura et al.
9,625,844 B2 4/2017 Kaya et al.
9,658,554 B2 5/2017 Kinumatsu et al.
9,715,188 B2 7/2017 Terauchi et al.
9,772,570 B2 9/2017 Tsuda et al.
9,798,256 B2 10/2017 Kosaki et al.
9,798,262 B2 10/2017 Toyoizumi et al.
9,811,016 B2 11/2017 Aoki et al.
9,823,595 B2 11/2017 Toyoizumi et al.
9,829,818 B2 11/2017 Yoshiba et al.
9,857,713 B2 1/2018 Kosaki et al.
9,869,943 B2 1/2018 Aoki et al.
9,964,874 B2 5/2018 Suzumura et al.
9,971,263 B2 5/2018 Fukudome et al.
10,101,683 B2 10/2018 Nishikawa et al.
10,162,280 B2 12/2018 Nishikawa et al.
2004/0110076 A1 7/2004 Yamazaki et al.
2010/0035171 A1 2/2010 Watanabe et al.
2013/0252167 A1 9/2013 Moribe et al.
2013/0309603 A1 11/2013 Takahashi et al.
2015/0125790 A1 5/2015 Hotta et al.
2015/0185658 A1 7/2015 Wakabayashi et al.
2016/0139522 A1 5/2016 Yoshiba et al.
2016/0161874 A1 6/2016 Yamazaki et al.
2016/0179024 A1 * 6/2016 Nishikawa ..... G03G 9/0821 430/108.7
2018/0173125 A1 6/2018 Fukudome et al.
2018/0173126 A1 6/2018 Ohmori et al.
2018/0231901 A1 8/2018 Koji et al.
2018/0329323 A1 11/2018 Kimura et al.

FOREIGN PATENT DOCUMENTS

JP 2015-045859 3/2015
JP 2016-133578 7/2016

* cited by examiner

EXTERNAL ADDITIVE, METHOD FOR MANUFACTURING EXTERNAL ADDITIVE, AND TONER

BACKGROUND OF THE INVENTION

Field of the Invention

The present invention relates to an external additive for use in image-forming methods including electrophotographic methods, to a method for manufacturing this external additive, and to a toner having this external additive.

Description of the Related Art

As image-forming apparatuses such as copiers and printers using electrophotographic technology have come to be used for more diverse purposes and in more diverse environments, there has been increasing demand for higher speeds and higher image quality. Because the time taken to pass through the fixing unit is shorter the faster the printer speed, the amount of heat received by the toner is reduced even if the temperature setting of the fixing unit is the same. Furthermore, lower fixing temperatures are also desirable from the standpoint of energy savings, and there is demand for toners with good low-temperature fixability.

Sharp melting of the toner in the fixing nip is desirable for improving low-temperature fixability, and designs that soften the surface layer of the toner particle and the like are in demand for this purpose. In particular, in high-speed printers in which less heat is received by the toner in the fixing nip, it is important to melt the surface layers of the toner particles in the fixing nip to thereby fuse the toner particles together.

Japanese Patent Application Publication No. 2004-212740 discloses a technology for increasing the low-temperature fixability and heat-resistant storage stability by externally adding an inorganic fine particle and a crystalline resin fine particle to the toner particle. Japanese Patent Application Publication No. 2013-83837 discloses a technology for improving developing performance and transferability by adding an external additive comprising an inorganic fine particle mechanically punched into the surface of a crystalline resin fine particle.

However, although low-temperature fixability is improved by these methods, the crystalline resin fine particles serve as charge leak sites, and have tended to cause uneven charge distribution and lower developing performance.

Japanese Patent Application Publication No. 2016-133578 discloses a technique for improving developing performance by adding to the toner an external additive consisting of a composite particle comprising an inorganic fine particle embedded in the surface of a resin fine particle. However, although this method improves developing performance, it has not succeeded in improving low-temperature fixability at high speeds.

In this context, Japanese Patent Application Publication No. 2015-45859 discloses a technique for improving low-temperature fixability and developing performance in high-temperature, high-humidity environments by externally adding to the toner particle a composite fine particle comprising an inorganic fine particle embedded in a resin fine particle with a melting point from 60° C. to 150° C.

SUMMARY OF THE INVENTION

However, with an external additive such as that described in Japanese Patent Application Publication No. 2015-45859 the embedded state of the inorganic fine particle on the surface of the resin fine particle is not uniform, and the degree of surface unevenness is not controlled. Consequently, there has not been sufficient adhesiveness derived from interlocking of the paper fibers with protruded portion and depressions on the surface of the external additive. As a result, when the toner is pressurized in the fixing nip it may deviate from its unfixed position on the paper and be fixed, forming fine aggregates that may cause small spots (hereunder called black spots) derived from the aggregates to appear in the image. These small spots can cause problems in areas where high image quality is required, such as graphic images and the like.

Thus, there is still room for improvement in terms of reducing black spots while improving low-temperature fixability by surface layer melting.

As discussed above, the inventors' researches have shown that considering the trend towards smaller, more energy efficient, longer lived and higher speed apparatuses, the toners described in Japanese Patent Application Publication No. 2004-212740, Japanese Patent Application Publication No. 2013-83837, Japanese Patent Application Publication No. 2016-133578 and Japanese Patent Application Publication No. 2015-45859 show room for improvement in terms of the need to reduce black spots while maintaining low-temperature fixability.

It is therefore an object of the present invention to obtain an external additive for toner that contributes to improving low-temperature fixability and heat-resistant storage stability and reducing black spots even if the speed of the image-forming apparatus is increased, along with a method for manufacturing the external additive and a toner having the external additive.

The present invention relates to an external additive having a resin particle containing a crystalline resin and an inorganic fine particle containing a metal atom, the inorganic fine particle being embedded in the resin particle, wherein part of the inorganic fine particle being exposed on a surface of the resin particle, in differential scanning calorimetry of the external additive, the maximum endothermic peak temperature during the first temperature rise is from 50.0° C. to 120.0° C., the external additive has a shape factor SF-2 of 110 to 150, the shape factor being measured in a scanning electron microscope image of the external additive at a magnification of 200,000, and the external additive satisfies following formulae (1) and (2) below, $$Za \geq 15 \quad (1),$$

$$Za/Zb \geq 0.7 \quad (2),$$

in the formulae (1) and (2),

Za represents a value calculated from following formula (3);

$$Za\ (\text{mass } \%) = \{dm \times (\text{atomic weight of the metal atom})\} / [\{dC \times (\text{atomic weight of carbon})\} + \{dO \times (\text{atomic weight of oxygen})\} + \{dm \times (\text{atomic weight of the metal atom})\}] \times 100 \quad (3),$$

in the formula (3):

"dm" represents a concentration of the metal atom on a surface of the external additive, "dC" represents a concentration of carbon atom at the surface of the external additive, "dO" represents a concentration of oxygen atom at the surface of the external additive, and "dm", "dC" and "dO" are obtained by X-ray photoelectron spectroscopy, Zb represents a value calculated from a following formula (9);

$$Zb\ (\text{mass }\%)=(\text{mass of the metal atom obtained from an ash content derived from the inorganic fine particle, the ash content being obtained by heating the external additive at 900° C. for 1 hour})/(\text{mass of the external additive})\times 100 \quad (9).$$

The present invention also relates to a method for manufacturing an external additive having a resin particle containing a crystalline resin and an inorganic fine particle being embedded in the resin particle, with part of the inorganic fine particle being exposed on the surface of the resin particle, having a step of co-dispersing the inorganic fine particle and the resin particle containing the crystalline resin in an aqueous medium to obtain a liquid dispersion, and a step of adjusting the pH of the resulting dispersion from a pH above 3.5 to a pH of 3.5 or less to accumulate the inorganic fine particle on the surface of the resin particle, wherein in differential scanning calorimetry of the external additive, the maximum endothermic peak temperature during the first temperature rise is from 50.0° C. to 120.0° C.

The present invention also relates to a toner comprising a toner particle containing a binder resin and a colorant, together with an external additive on the surface of the toner particle, wherein the external additive is the external additive described above.

With the present invention, it is possible to obtain an external additive for toner that contributes to improving low-temperature fixability and heat-resistant storage stability and reducing black spots even if the speed of the image-forming apparatus is increased, together with a method for manufacturing the external additive and a toner comprising the external additive.

Further features of the present invention will become apparent from the following description of exemplary embodiments with reference to the attached drawing.

DESCRIPTION OF THE EMBODIMENTS

Figure 1:
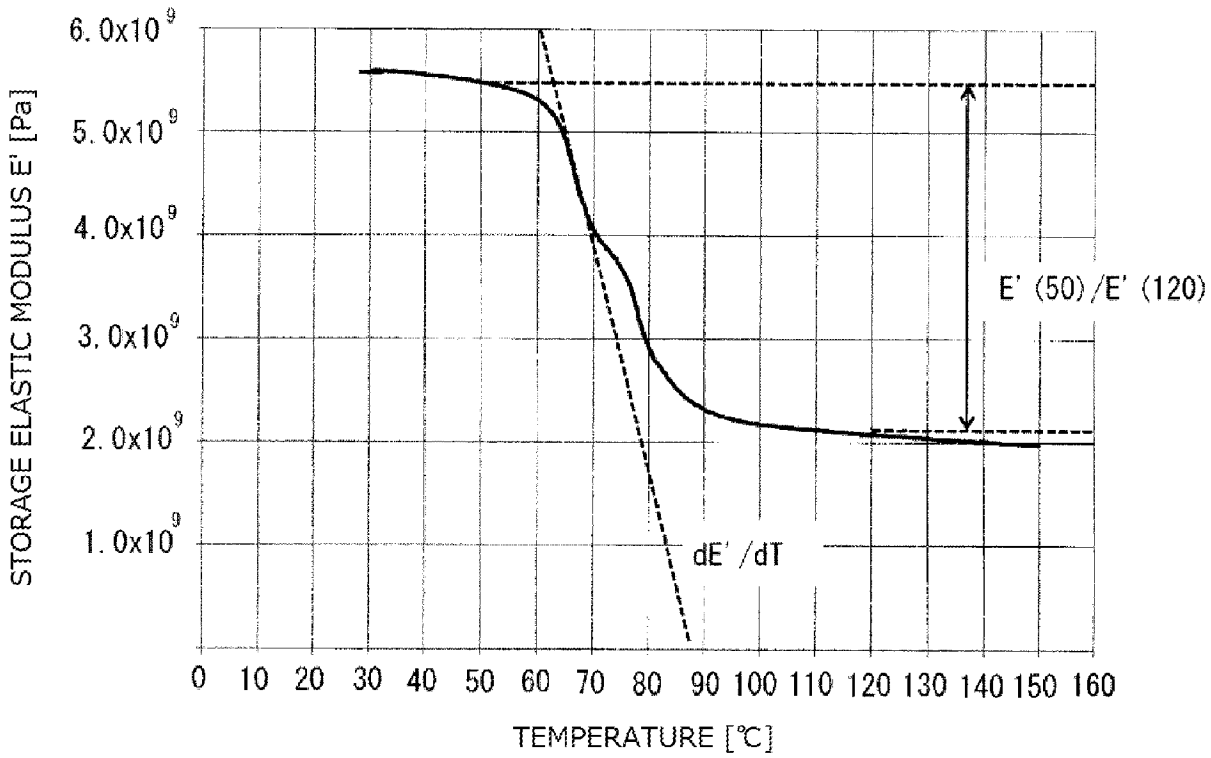
FIG. 1 is a temperature T-storage modulus E' curve obtained by powder dynamic viscoelasticity measurement.

Unless otherwise specified, descriptions of numerical ranges such as "from A to B" or "A to B" in the present invention include the numbers at the upper and lower limits of the range.

In the present invention, the combination of the upper and lower limits of a range may be determined from all combinations of upper and lower limits given in the Description.

The external additive of the invention has a resin particle containing a crystalline resin and an inorganic fine particle containing a metal atom. The inorganic fine particle is embedded in the resin particle. That is, the external additive of the invention is characterized by having part of the inorganic fine particle exposed on a surface of the resin particle, forming protruded portion derived from the inorganic fine particle.

The purpose of using a resin particle containing a crystalline resin is to improve the lower-temperature fixability of the toner by melting the crystalline resin at the time of fixing and promoting surface layer adhesion between toner particles. This is why the maximum endothermic peak temperature during the first temperature rise in differential scanning calorimetry of the external additive of the invention is from 50.0° C. to 120.0° C.

If the maximum endothermic peak temperature is less than 50.0° C., the heat-resistant storage stability of the external additive may be insufficient. If the maximum endothermic peak temperature exceeds 120.0° C., the effect of improving the low-temperature fixability of the toner is small. The maximum endothermic peak temperature is preferably at least 60° C., and the upper limit is preferably not more than 110° C.

The purpose of embedding the inorganic fine particle in the surface of the resin particle with part exposed to form protruded portion derived from the inorganic fine particle is to increase the contact area between the external additive and both the toner particle and the paper in the fixing step, thereby increasing the attachment force between the unfixed toner and the paper and suppressing toner detachment.

As discussed above, the external additive of the invention is non-spherical in shape, and the degree of non-sphericity is specified by the shape factor SF-2 as defined by the following formula (8).

$$(\text{shape factor SF-2})=(\text{perimeter of primary particle of external additive})^2/(\text{area of primary particle of external additive})\times 100/4\pi\pi \quad (8)$$

The perimeter and area of the primary particle of the external additive needed for determining SF-2 are measured in a scanning electron microscope image of the external additive at a magnification of 200,000.

The SF-2 is from 110 to 150. If the value of SF-2 is less than 110, this means that the inorganic fine particle is embedded too deeply in the resin particle leaving only small protruded portion, thereby reducing the adhesiveness between the external additive and the toner particle and making the external additive more likely to detach from the toner particle, with the result that adhesiveness between the paper and the toner may be less.

If the SF-2 is over 150, on the other hand, the inorganic fine particle may be more likely to detach from the resin particle because the inorganic fine particle is insufficiently embedded in the resin particle. The SF-2 is preferably from 120 to 150.

The SF-2 can be controlled by controlling the primary particle diameter and hydrophobicity of the inorganic fine particle, the amount of the inorganic fine particle added to the resin particle, and the temperature, pH and the like when accumulating the inorganic fine particle on the surface of the resin particle.

The states of the resin particle and inorganic fine particle in the external additive can be specified by comparing the results of X-ray photoelectron spectroscopy (XPS) with the results of thermogravimetric analysis (TGA).

Specifically, the total of the concentration of carbon atom dC, the concentration of oxygen atom dO, and the concentration dm of the metal atom derived from the inorganic fine particle on the surface of the external additive in XPS is given as 100.0 atomic %. The percentage content of the metal atom derived from the inorganic fine particle is then determined by the following formula (3) and expressed as Za [mass %], $$Za\ [\text{mass }\%]=\{dm\times(\text{atomic weight of the metal atom})\}[\{dC\times(\text{atomic weight of carbon})\}+\{dO\times(\text{atomic weight of oxygen})\}+\{dm\times(\text{atomic weight of the metal atom})\}]\times 100 \quad (3).$$

In TGA, meanwhile, the percentage content of the metal atom is calculated from a following formula (9), and expressed as Zb [mass %].

$$Zb(\text{mass }\%)=(\text{mass of the metal atom obtained from an ash content derived from the inorganic fine particle, the ash content being obtained by heating the external additive at 900° C. for 1 hour})/(\text{mass of the external additive})\times 100 \quad (9).$$

Based on this, formulae (1) and (2) below are satisfied, $$Za\geq 15 \quad (1),$$

$$Za/Zb\geq 0.7 \quad (2),$$

$$Za\geq 17 \quad (1'), \text{ and}$$

$$Za/Zb\geq 1.0 \quad (2').$$

If Za is less than 15, this means that the protruded portion derived from the inorganic fine particle in the surface layer of the external additive are less exposed and fewer in number. Adhesiveness of the external additive with the toner particle is therefore reduced, the toner is more likely to detach from the paper, and there is a risk of black spots.

Preferably Za satisfies formula (1'). There is no particular upper limit to Za, but preferably it is not more than 50, or more preferably not more than 35. Za can be controlled by controlling the hydrophobicity of the inorganic fine particle, the amount of the inorganic fine particle added relative to the resin particle, and the temperature and pH conditions and the like when the inorganic fine particle is accumulated on the surface of the resin particle.

If Za/Zb is less than 0.7, on the other hand, this means either that the protruded portion are small because the inorganic fine particle is too much embedded in the resin particle, or that the inorganic fine particle is buried inside the resin particle.

When the protruded portion are small, adhesiveness of the external additive with the paper is less, and the unfixed toner is more likely to detach from the paper, potentially causing black spots. When the inorganic fine particle is buried, melting of the resin particle is inhibited, and the effect of improving the low-temperature fixability of the toner is smaller. Za/Zb preferably satisfies formula (2').

There is no particular upper limit of Za/Zb, but preferably it is not more than 2.8, or more preferably not more than 2.5. Zb can be controlled by controlling the amount of the inorganic fine particle added relative to the resin particle.

The number-average particle diameter of a primary particle of the external additive according to the dynamic light scattering method is preferably from 30 nm to 500 nm, or more preferably at least 50 nm. The upper limit is preferably not more than 300 nm, or more preferably not more than 250 nm. This is because controlling the particle diameter of the external additive within a fixed range makes it easier to melt the surface layer of the external additive on the surface of the toner particle when the toner is melted in the fixing nip, and attach the toner uniformly to the paper.

The inorganic fine particle used in the external additive is preferably at least one selected from the group consisting of a silica fine particle, alumina fine particle, titania fine particle, zinc oxide fine particle, strontium titanate fine particle, cerium oxide fine particle and calcium carbonate fine particle. That is, the metal atom in the XPS and TGA above is preferably of at least one kind selected from the group consisting of Si, Al, Ti, Zn, Sr, Ce and Ca. Si is sometimes classified as a semimetal, but is treated as a metal in the present invention.

An external additive for toner using a silica fine particle as an inorganic fine particle is particularly desirable because it imparts superior charging performance to the toner when combined with the toner particle. The silica fine particle may be fumed silica or the like obtained by a dry process, or may be obtained by a wet process such as a sol-gel process.

The crystalline resin contained in the resin particle used in the external additive is explained here. The crystalline resin is a resin having a clear melting point in differential scanning calorimetry. The crystalline resin is not particularly limited, and examples include crystalline polyester resins, crystalline polyurethane resins, crystalline acrylic resins, ethylene-vinyl acetate copolymers, and vinyl resins grafted with modified waxes and the like.

As discussed above, the maximum endothermic peak temperature of the external additive during the first temperature rise in differential scanning calorimetry is from 50.0° C. to 120.0° C. It is thus possible to plasticize the surface layer of the toner particle and promote surface layer adhesion between toner particles. Because polyester resin is polar, it increases the adhesion between the external additive and the paper, making it easier to improve low-temperature fixability. Consequently, the crystalline resin preferably contains a crystalline polyester, and more preferably is a crystalline polyester.

The method for manufacturing the crystalline polyester is not particularly limited, and a conventional known manufacturing method may be used as long as it does not detract from the effects of the invention. For example, the crystalline polyester may be manufactured by condensation polymerization of a polyhydric alcohol and a polyvalent carboxylic acid.

Examples of the polyhydric alcohol include, but are not limited to, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. These may be used individually, or a mixture thereof may be used.

Examples of the polyvalent carboxylic acid include, but are not limited to, oxalic acid, malonic acid, succinic acid, glutaric acid, adipic acid, pimelic acid, suberic acid azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, as well as lower alkyl esters and acid anhydrides of these. These may be used individually, or a mixture thereof may be used.

The method for manufacturing the crystalline polyester is not particularly limited, and it can be manufactured by an ordinary polyester polymerization method in which the acid component is reacted with the alcohol component. For example, direct polycondensation and transesterification methods can be used separately as appropriate according to the types of monomers.

The crystalline resin contained in the resin particle used in the external additive preferably has an acid value compatible with the resin particle manufacturing method explained below. This acid value is preferably from 5.0 mgKOH/g to 30.0 mgKOH/g, or more preferably from 6.0 mgKOH/g to 27.0 mgKOH/g.

If the acid value is at least 5.0 mgKOH/g, the resin particle is easier to manufacture by phase inversion emulsification. On the other hand, an acid value of not more than 30.0 mgKOH/g is desirable for increasing the degree of crystallization of the crystalline resin and obtaining the external additive with good heat-resistant storage stability.

The number average molecular weight of the crystalline resin contained in the resin particle is preferably from 3,000 to 60,000. If it is at least 3,000, it is easy to increase the degree of crystallization of the crystalline resin and obtain the external additive with good heat-resistant storage stability. If it is not more than 60,000, on the other hand, the ability to plasticize the surface layer of the toner particle is greater, increasing the effect of improving the low-temperature fixability of the toner. More preferably, the number average molecular weight is from 5,000 to 50,000.

Various methods are possible for manufacturing the external additive. To obtain the external additive with the properties described above, a method of electrostatically affixing the inorganic fine particle to the surface of the resin particle is preferred.

The method for manufacturing the resin particle is explained first. The resin particle is preferably manufactured by one of the following two methods for example.

The first method for manufacturing the resin particle is a manufacturing method comprising a step a of preparing a crystalline resin solution 1 comprising the crystalline resin dissolved in an organic solvent, a step b of preparing a crystalline resin solution 2 by adding a neutralizing agent with an acid dissociation constant pKa of at least 7.0 to the crystalline resin solution 1, and a step c of adding water to this crystalline resin solution 2 to prepare a liquid dispersion A of the resin particle by phase inversion emulsification, and obtain the resin particle.

A resin other than the crystalline resin may also be co-dissolved in the crystalline resin solution 1 during this process. The "pKa" is the acid dissociation constant. This first manufacturing method preferably also includes a step of removing the organic solvent contained in the liquid dispersion A. A conventional known method such as a depressurization operation, solvent extraction or steam distillation may be applied to the step of removing the organic solvent.

The purpose of adding a neutralizing agent with a pKa of at least 7.0 in the step b is to neutralize the acidic functional groups of the crystalline resin or the acidic functional groups of a resin that has been co-dissolved with the crystalline resin. This promotes dissociation of the acidic functional groups in the step c, so that the dispersion stability of the resin particle contained in the liquid dispersion A can be ensured by electrostatic repulsive force.

To impart good dispersion stability to the resin particle, the pKa of the neutralizing agent is preferably from 7.5 to 14.0, or more preferably from 9.5 to 13.0. Within this range, it is easy to obtain a resin particle with a sharp particle size distribution.

Examples of the neutralizing agent include, but are not limited to, those given below. The temperatures in brackets are boiling points.

Examples include ammonia water (−33° C.), amines such as N-methyl-ethanolamine (155° C.), N,N-dimethylethanolamine (133° C.), 2-diethylaminoethanol (161° C.), triethylamine (90° C.), ethanolamine (170° C.), triethanolamine (208° C.), N-methyl-diethanolamine (246° C.), tri-n-butylamine (216° C.), bis-3-hydroxypropylamine (185° C.), 2-amino-2-methyl-1-propanol (165° C.), 1-amino-2-propanol (160° C.), 2-amino-2-methyl-1,3-propanediol (151° C.), cyclohexylamine (135° C.), t-butylamine (78° C.), N-methylmorpholine (115° C.) and hydroxylamine (58° C.), salts of weak acids and strong bases, such as sodium carbonate and potassium carbonate, and alkali metal hydroxides such as sodium hydroxide and potassium hydroxide. These may be used individually, or a mixture thereof may be used.

The boiling point of the neutralizing agent is preferably not more than 140° C., or more preferably from 0° C. to 130° C. If the boiling point is not more than 140° C., it is easier to remove excess neutralizing agent not used to neutralize the acidic functional groups. The neutralizing agent is thus less likely to become a residue, and the crystalline resin is less likely to be plasticized, resulting in good heat-resistant storage stability. A volatile neutralizing agent is unlikely to form a residue, and for example ammonia, triethylamine, dimethanolamine or the like is preferred.

The amount of the neutralizing agent added is preferably from 1 mass part to 20 mass parts per 100 mass parts of the crystalline resin.

The second method for manufacturing the resin particle is a manufacturing method comprising a step d of preparing a crystalline resin solution 3 comprising the crystalline resin dissolved in an organic solvent, and a step e of mixing the crystalline resin solution 3 with an aqueous medium and stirring to prepare a liquid dispersion B and obtain a resin particle, wherein either or both of the crystalline resin solution 3 and the aqueous medium contains a surfactant.

A resin other than the crystalline resin may also be co-dissolved in the crystalline resin solution 3. This second manufacturing method preferably also includes a step of removing the organic solvent from the dispersed matter containing the crystalline resin in the liquid dispersion B. A conventional known method such as a depressurization operation, solvent extraction or steam distillation may be applied to the step of removing the organic solvent.

The surfactant is preferably a low-molecular weight surfactant with a weight-average molecular weight of not more than 1,000. If the weight-average molecular weight is not more than 1,000, the surfactant can later be removed efficiently from the resulting resin particle. The surfactant may be a known anionic surfactant, cationic surfactant or non-ionic surfactant.

Specific examples of anionic surfactants include dodecylbenzene sulfonate, decylbenzene sulfonate, undecylbenzene sulfonate, tridecylbenzene sulfonate, nonylbenzene sulfonate and sodium, potassium and ammonium salts of these, sodium dodecyl sulfonate and the like.

Specific examples of cationic surfactants include cetyl trimethyl ammonium bromide, hexadecyl pyridinium chloride and hexadecyl trimethyl ammonium chloride.

Specific examples of non-ionic surfactants include oxyethylene alkyl ethers and the like. Two or more kinds of surfactants may also be used together.

Although the use of an organic solvent is common to both the first manufacturing method and the second manufacturing method, there is some difference in what kinds of solvents can be used. In the first manufacturing method, any conventional known organic solvent capable of dissolving the crystalline resin may be used.

In the second manufacturing method, however, the organic solvent is preferably one that can not only dissolve the crystalline resin, but that also undergoes liquid/liquid phase separation with aqueous media. An organic solvent with a solubility of not more than 10 g/100 mL in 20° C. water is more preferred. Examples of such organic solvents include, but are not limited to, hexane, toluene, chloroform and ethyl acetate. These may be used individually or in a mixture.

Moreover, a disperser such as a homogenizer, ball mill, colloid mill or ultrasound disperser may be used as a dispersing apparatus when preparing the liquid dispersion in either the first manufacturing method or second manufacturing method.

Whether manufactured by the first manufacturing method or second manufacturing method, the resin particle is preferably subjected to a purification step before being stored. The purification step is not particularly limited, and for example a conventional method such as centrifugation, dialysis or ultrafiltration may be used.

The method for manufacturing the external additive is explained next.

This is a method for manufacturing an external additive having a resin particle containing a crystalline resin and an inorganic fine particle being embedded in the resin particle, with part of the inorganic fine particle being exposed on a surface of the resin particle, having a step of co-dispersing the inorganic fine particle and the resin particle containing the crystalline resin in an aqueous medium to obtain a liquid dispersion, and a step of adjusting the pH of the resulting dispersion from a pH above 3.5 to a pH of 3.5 or less to accumulate the inorganic fine particle on the surface of the resin particle, wherein in differential scanning calorimetry of the external additive, the maximum endothermic peak temperature during the first temperature rise is from 50.0° C. to 120.0° C.

The inventors discovered that an inorganic fine particle could be fixed uniformly on the surface of a resin particle based on static interactions by adjusting the pH with the resin particle and inorganic fine particle in a co-dispersed state to thereby alter the zeta potential of either or both of the resin particle and the inorganic fine particle.

Because ordinary inorganic fine particles have zeta potential due to hydroxyl groups or hydrophobic hydration structures formed on the surface of the inorganic fine particles, the pH is preferably adjusted to 3.0 or less, or more preferably to 2.5 or less. The inventors believe that because a pH of 2.5 or less corresponds to the pH near the isoelectric point of the inorganic fine particles, the zeta potential of the inorganic fine particles approaches infinitely close to 0 mV, and the inorganic fine particles accumulate extremely efficiently on the surface of the resin particle as a result. There is no particular lower limit to the adjusted pH, but preferably it is at least 0.5, or more preferably at least 1.0.

The pH above 3.5 is preferably a pH of 4.0 to 14.5, or more preferably a pH of 5.5 to 14.0.

In manufacturing the external additive, the hydrophobicity of the inorganic fine particle is preferably not more than 30.0 methanol vol %, or more preferably not more than 25.0 methanol vol %. There is no particular lower limit, but preferably it is at least 3.0 methanol vol %, or more preferably at least 5.0 methanol vol %.

Hydrophobicity here is a value determined by wettability testing of the inorganic fine particle with methanol, and when the hydrophobicity is not more than 30.0 methanol vol %, the inorganic fine particle and resin particle are easily co-dispersed in an aqueous medium, and the inorganic fine particle are less likely to aggregate together when they are accumulated on the surface of the resin particle by pH adjustment.

In the method for manufacturing the external additive, the amount of the inorganic fine particle added when co-dispersing the resin particle and inorganic fine particle in an aqueous medium is preferably from 20 mass parts to 80 mass parts, or more preferably from 25 mass parts to 70 mass parts per 100 mass parts of the resin particle.

If the amount is at least 20 mass parts, the accumulated state of the inorganic fine particles tends to be uniform when they are accumulated on the surface of the resin particle by pH adjustment. If it is not more than 80 mass parts, the inorganic fine particle and resin particle are easily co-dispersed in an aqueous medium, and the inorganic fine particles are less likely to aggregate together when they are accumulated on the surface of the resin particle by pH adjustment.

In the method for manufacturing the external additive, moreover, given Rx (nm) as the number-average particle diameter of a primary particle of the inorganic fine particle and Ry (nm) as the number-average particle diameter of a primary particle of the resin particle, Ry/Rx preferably satisfies formula (7) below.

$$5.0 \leq Ry/Rx \leq 100.0 \quad (7)$$

If Ry/Rx is at least 5.0, the degree of non-sphericity as specified by SF-2 is sufficient. If Ry/Rx is not more than 100, the accumulated state of the inorganic fine particles tends to be uniform when they are accumulated on the surface of the resin particle by pH adjustment, and the inorganic fine particles are more easy to fix uniformly. Ry/Rx is preferably from 6.0 to 50.0, or more preferably from 7.0 to 35.0.

In the step of accumulating the inorganic fine particles on the surface of the resin particle, the embedded state of the inorganic fine particles in the resin particle is preferably controlled by heating the aqueous medium.

Specifically, in differential scanning calorimetry of the crystalline resin contained in the resin particle, given T1 [° C.] as the onset temperature of the maximum endothermic peak during the first temperature rise and T2 [° C.] as the temperature of the liquid dispersion in the step of accumulating the inorganic fine particles on the surface of the resin particle, preferably formulae (4) to (6) below are satisfied, $$50.0 \leq T1 \leq 120.0 \quad (4),$$

$$|T2-T1| \leq 30.0 \quad (5), \text{ and}$$

$$T2 \leq 100.0 \quad (6).$$

By heating the aqueous medium to a specific temperature range from the onset temperature of the maximum endothermic peak of the crystalline resin, the surface of the resin particle becomes less sticky and it is possible to quickly embed the accumulated inorganic fine particles in the surface of the resin particle.

If T2 is at least the onset temperature T1−30.0° C., the surface of a resin particle composed of the crystalline resin is easily softened, and the inorganic fine particle is easily embedded. If T2 is not more than the onset temperature T1+30.0° C., on the other hand, the surface of the resin particle does not become too soft, the inorganic fine particles are embedded to a suitable degree, and aggregation of the resin particles with each other is suppressed. |T2−T1| is more preferably from 0° C. to 25° C.

Aggregation of the external additive with each other can be suppressed by making T2 be not more than 100.0° C. T2 is more preferably from 20.0° C. to 100.0° C.

If T1 is at least 50.0° C., moreover, the external additive does not fuse even if exposed to a certain amount of heat during toner storage, resulting in good heat-resistant storage stability. T1 is more preferably from 50.0° C. to 120.0° C.

The greater the degree of embedding of the inorganic fine particle, the greater the attachment force between the inorganic fine particles and the surface of the resin particle.

Exposure to ultrasound during the step of accumulating the inorganic fine particles on the surface of the resin particle is also effective as a method for embedding the inorganic fine particles in the surface of the resin particle.

A step of treating the external additive with a hydrophobic agent is preferably included after the step of accumulating the inorganic fine particles on the surface of the resin particle. Specifically, the surface of the external additive is preferably treated with a hydrophobic agent such as an organic silicon compound or silicone oil. Because this increases the hydrophobicity of the external additive, it can provide a toner having stable developing performance even in high-temperature, high-humidity environments.

For example, hydrophobization can be accomplished by chemical treatment with an organic silicon compound that reacts with or is physically adsorbed by the surface of the resin particle.

In a preferred method, a silica fine particle produced by vapor phase oxidation of a silicon halogen compound is treated with an organosilicon compound. Examples of the organosilicon compound include the following.

Examples include dimethyl disilazane, hexamethyl disilazane, methyl trimethoxysilane, octyl trimethoxysilane, isobutyl trimethoxysilane, trimethylsilane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethyl chlorosilane, α-chloroethyl trichlorosilane, β-chloroethyl trichlorosilane, chloromethyl dimethyl chlorosilane, triorganosilyl mercaptane, trimethylsilyl mercaptane, triorganosilyl acrylate, vinyl dimethyl acetoxysilane, dimethyl ethoxysilane, dimethyl dimethoxysilane, diphenyl diethoxysilane, 1-hexamethyl disiloxane, 1,3-divinyltetramethyl disiloxane, 1,3-diphenyltetramethyl disiloxane, and dimethylpolysiloxanes having 2 to 12 siloxane units in the molecule and having one hydroxyl group for each Si in a terminal position. One of these or a mixture of two or more may be used.

The inorganic fine particle used in the external additive may also have been treated with silicone oil, or it may have been treated with silicone oil in addition to the aforementioned hydrophobic treatment. Examples of silicone oil include dimethyl silicone oil, methylphenyl silicone oil, α-methylstyrene modified silicone oil, chlorophenyl silicone oil, fluorine modified silicone oil and the like.

The following are examples of the method of silicone oil treatment: a method in which an inorganic fine particle such as a silica particle that has been treated with a silane coupling agent is directly mixed with a silicone oil in a mixer such as a Henschel mixer; a method in which a silicone oil is sprayed on the inorganic fine particle as a base; with a method in which a silicone oil is first dissolved or dispersed in a suitable solvent, the inorganic fine particle is added and mixed, and the solvent is then removed being more preferred.

A toner using the external additive of the invention is explained next. The toner of the invention is a toner having a toner particle containing a binder resin and a colorant, and an external additive on the surface of the toner particle, wherein the external additive includes the external additive described above.

A known binder resin may be used, without any particular limitations. Examples include monopolymers of styrenes and substituted styrenes, such as polystyrene, poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylic acid ester copolymer and styrene-methacrylic acid ester copolymer; and polyvinyl chloride, phenol resin, natural resin-modified phenol resin, natural resin-modified maleic acid resin, acrylic resin, methacrylic resin, polyvinyl acetate, silicone resin, polyurethane resin, polyamide resin, furan resin, epoxy resin, xylene resin, polyethylene resin, polypropylene resin and the like.

A polyester resin is preferred, and an amorphous polyester resin is especially preferred.

The polyester resin is preferably a condensation polymer of an alcohol component and an acid component. The following compounds are examples of monomers for producing the polyester resin.

Examples of alcohol components include the following dihydric alcohols:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and the bisphenol represented by formula (I) below and its derivatives.

Examples of trihydric and higher polyhydric alcohol components include 1,2,3-propanetriol, trimethylolpropane, hexanetriol, pentaerythritol and the like.

(I)

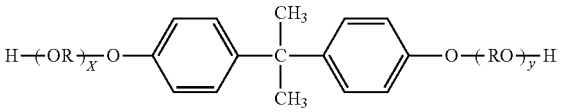

In the formula, R represents an ethylene or propylene group, X and Y are each 0 or an integer greater than 0, and the average value of X+Y is from 0 to 10.

Examples of the acid component include the following bivalent carboxylic acids:

benzene dicarboxylic acids, such as phthalic acid, terephthalic acid, isophthalic acid and phthalic anhydride, or their anhydrides; alkyl dicarboxylic acids such as succinic acid, adipic acid, sebacic acid and azelaic acid, or their anhydrides; succinic acid substituted with $C_{6-18}$ alkyl or $C_{6-18}$ alkenyl groups, or anhydrides thereof; and unsaturated dicarboxylic acids such as fumaric acid, maleic acid, citraconic acid and itaconic acid, or their anhydrides.

A trivalent or higher polyvalent carboxylic acid is also desirable as the acid component. Examples include 1,2,4-benzenetricarboxylic acid (trimellitic acid), 1,2,4-cyclohexanetricarboxylic acid, 1,2,4-naphthalenetricarboxylic acid and pyromellitic acid, and acid anhydrides or lower alkyl esters of these.

Conventional known black, yellow, magenta, cyan and other colored pigments and dyes and magnetic materials and the like may be used as the colorant, without any particular limitations.

The content of the colorant is preferably 1 mass part to 20 mass parts per 100 mass parts of the binder resin.

The toner may also be a magnetic toner containing a magnetic material. In this case, the magnetic material may also serve as a colorant. Examples of magnetic materials include iron oxides such as magnetite, hematite and ferrite; and metals such as iron, cobalt and nickel, or alloys of these metals with other metals such as aluminum, cobalt, copper, lead, magnesium, tin, zinc, antimony, beryllium, bismuth, cadmium, calcium, manganese, selenium, titanium, tungsten and vanadium, and mixtures of these and the like.

When a magnetic material is used, the content thereof is preferably from 40 mass parts to 140 mass parts per 100 mass parts of the binder resin.

The toner may also contain a release agent. Examples of the release agent include the following:

low-molecular weight polyolefins such as polyethylene; silicones having melting points (softening points) when heated; fatty acid amides such oleamide, erucamide, ricinolamide and stearamide; ester waxes such as stearyl stearate; plant waxes such as carnauba wax, rice wax, candelilla wax, Japan wax and jojoba wax; animal waxes such as beeswax; mineral and petroleum waxes such as Montan wax, ozokerite, ceresin, paraffin wax, microcrystalline wax, Fischer-Tropsch wax and ester wax; and modified products of these.

The content of the release agent is preferably from 1 mass part to 25 mass parts per 100 mass parts of the binder resin.

A flowability improver other than the external additive may also be added to improve the flowability and charging performance of the toner.

Examples of the flowability improver include fluorine resin powders such as vinylidene fluoride fine powder and polytetrafluoroethylene fine powder; fine silica powders such as wet silica and dry silica, titanium oxide powder, alumina powder, and treated silica obtained by surface treating these with a silane compound, titanium coupling agent or silicone oil; oxides such as zinc oxide and tin oxide; composite oxides such as strontium titanate, barium titanate, calcium titanate, strontium zirconate and calcium zirconate; and carbonate compounds such as calcium carbonate and magnesium carbonate.

The number-average particle diameter of a primary particle of the flowability improver is preferably from 5 nm to 200 nm in order to impart good flowability and charging performance.

The effects of the external additive of the invention can be obtained by externally adding it to the toner particle surface. The method for manufacturing the toner particle is not particularly limited, and for example a pulverization method or a polymerization method such as emulsion polymerization, suspension polymerization or dissolution suspension may be used. A toner can be obtained by thoroughly mixing the external additive and the toner particle in a mixer such as a HENSCHEL MIXER.

The mixer may be an FM MIXER (Nippon Coke & Engineering Co., Ltd.); SUPER MIXER (Kawata Mfg Co., Ltd.); RIBOCONE (Okawara Mfg. Co., Ltd); NAUTA MIXER, TURBULIZER or CYCLOMIX (Hosokawa Micron Corporation); SPIRAL PIN MIXER (Pacific Machinery & Engineering Co., Ltd.), or LOEDIGE MIXER (Matsubo Corporation), NOBILTA (Hosokawa Micron Corporation) or the like.

The amount of the external additive of the invention added is preferably from 0.1 mass part to 5.0 mass parts per 100 mass parts of the toner particle.

In a temperature T [° C.]-storage elastic modulus E' [Pa] curve obtained by powder dynamic viscoelasticity measurement of the toner, a curve of the change in the storage elastic modulus E' relative to the temperature T (dE'/dT) shows minimum values of not more than $-1.0\times10^7$ within a temperature range between the onset temperature of the dE'/dT curve and 90° C., and the minimum value at the lowest temperature end of the curve is preferably not more than $-90\times10^7$, or more preferably not more than $-9.5\times10^7$.

There is no particular lower limit, but preferably it is at least $-20.0\times10^7$, or more preferably at least $-18.0\times10^7$.

This powder dynamic viscoelasticity measurement can measure the viscoelasticity of the toner in a powder state, and the storage elastic modulus E' [Pa] shown by this measurement is thought by the inventors to indicate the melting state of the toner.

FIG. 1 shows an example of a temperature T [° C.]-storage elastic modulus E' [Pa] curve obtained by powder dynamic viscoelasticity measurement of the toner. It can be seen from FIG. 1 that a two-stage drop in the storage elasticity modulus occurs when the storage elasticity modulus is measured against the temperature of the toner in powder dynamic viscoelasticity measurement. The inventors believe that the reason for the two-stage drop is that melting near the toner particle surface and melting of the toner particle as a whole appear at different points.

When the toner is subject to external heat, the area near the toner particle surface naturally receives the heat first, so the drop in the storage elastic modulus on the low-temperature end is thought to represent melting near the surface of the toner particle. The rate of decline in the storage elastic modulus relative to temperature signifies the speed of toner melting.

Thus, the "minimum value at the lowest temperature end" is thought to represent the potential melting properties near the surface of the toner particle. The larger this value on the negative side, the greater the change in the storage elastic modulus of the toner relative to temperature, indicating a toner with strong melting performance near the surface.

The minimum value can be controlled by controlling the amount added and melting point of the external additive of the invention and the type of the crystalline resin. One way of increasing this minimum value on the negative side is to use a crystalline resin with a low melting point.

The various physical property measurements in the present invention are explained below.

Method for Measuring Percentage Content Za of Metal Atom

The percentage content of metal atom derived from the inorganic fine particle contained in the external additive on the surface of the toner particle or in the external additive by itself is calculated based on the results of a surface composition analysis of metal atomic weights by X-ray photoelectron spectroscopy (XPS). The XPS equipment and measurement conditions are as follows.

When the content is measured from the toner, the external additive on the surface of the toner particle is distinguished by the following method. 1 g of the toner is weighed exactly, and dispersed in 100 mL of water to which 1 mg of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) has been added. The dispersion is exposed to ultrasound, and treated at a specific strength in a centrifuge to separate and dry the supernatant. This is then observed at a magnification of 200,000 under a scanning electron microscope (SEM) "S-4800" (Hitachi, Ltd.) to confirm that only the external additive is present in the visual field.

Equipment: Quantum 2000, Ulvac-Phi, Inc.
Analysis method: Narrow analysis
X-ray source: Al-Kα
X-ray conditions: 100 μm, 25 W, 15 kV
Photoelectron uptake angle: 45°
Pass Energy: 58.70 eV
Measurement range: φ100 μm Measurement is performed under the above conditions, and the peak derived from the C—C bond in the carbon is orbital is corrected to 285 eV. The relative sensitivity factors provided by Ulvac-Phi, Inc. are then used from the peak areas of the eta atom for which peak tops are detected at from 100 eV to 103 eV. The concentration dC of carbon atom and the concentration dO of oxygen atom on the surface of the external additive and the concentration dm of the metal atom contained in the inorganic fine particle on the surface of the external additive are then measured. As to whether the metal atom is metal atom contained in the inorganic fine particle, the concentration of the metal atom obtained by measuring the external additive is assumed to represent metal atom contained in the inorganic fine particle.

Given 100.0 atomic % as the total of dC, dO and dm, the percentage content Za of metal atom derived from the inorganic fine particle contained in the external additive is determined by the following formula (3). When using multiple inorganic fine particles, the concentrations of each metal atom contained in the inorganic fine particles are measured, and the results of the following formula (3) are combined.

$$Za\ [\text{mass }\%]=\{dm\times(\text{atomic weight of the metal atom})\}/[\{dC\times(\text{atomic weight of carbon})\}+\{dO\times(\text{atomic weight of oxygen})\}+\{dm\times(\text{atomic weight of the metal atom})\}]\times 100 \quad (3)$$

Method for Measuring Percentage Content Zb of Metal Atom

The percentage content Zb of the metal atom obtained from ash content derived from the inorganic fine particle contained in the external additive is calculated from measurement results obtained using a TGA Q5000IR thermogravimetric apparatus (TA Instruments). The measurement conditions are as follows.

10.0 mg of the external additive is weighed exactly into a sample pan, and set in the main unit. The temperature is then maintained at 50° C. for 1 minute in an oxygen gas atmosphere, after which the sample is heated to 900° C. at a rate of 25° C./minute and hold for 1 hour at 900° C., and the mass of the sample (equal to the ash content) at this point is measured. The percentage content of the metal atom contained in the external additive is then determined by the following formula (10) from the mass (W1) of the initial sample and the mass (W2) of ash content derived from the inorganic fine particle.

$$Zb\ (\text{mass }\%)=W2/W1\times(\text{atomic weight of metal atom contained in inorganic fine particle})/(\text{molecular weight of inorganic fine particle})\times 100 \quad (10)$$

Incidentally, formula (10) is synonymous with formula (9).

$$Zb\ (\text{mass }\%)=\{W2\times(\text{atomic weight of metal atom contained in inorganic fine particle})/(\text{molecular weight of inorganic fine particle})\}/W1\times 100=(\text{mass of the metal atom obtained from an ash content derived from the inorganic fine particle, the ash content being obtained by heating the external additive at 900° C. for 1 hour})/(\text{mass of the external additive})\times 100 \quad (9)$$

In addition, when the ash content contains components not derived from the inorganic fine particle contained in the external additive, an ash content derived from the inorganic fine particle is determined by determining the content of the components by a known method and subtracts it from the ash content.

Separation of External Toner Additive from Toner

When measuring the content from the toner, the external additive on the surface of the toner particle is distinguished by the following method.

1 g of the toner is weighed exactly, and dispersed in 100 mL of water to which 1 mg of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) has been added. The dispersion is exposed to ultrasound, and treated at a specific strength in a centrifuge to separate and dry the supernatant. This is then observed at a magnification of 200,000 with a scanning electron microscope (SEM) "S-4800" (Hitachi, Ltd.) to confirm that only the external additive is present in the visual field.

Method for Measuring Shape Factor SF-2 of External Toner Additive

The external additive by itself or the toner with the external additive externally added thereto is observed under a scanning electron microscope (SEM) "S-4800" (Hitachi, Ltd.), The periphery and area of 100 primary particles of the external additive are calculated using image processing software "Image-Pro Plus 5.1J" (Media Cybernetics, Inc.) in a visual field magnified 200,000. The SF-2 of each external additive is calculated by the above formula (8), and the arithmetic average of the 100 external additives is given as the SF-2 stipulated by the present invention.

Method for Measuring Maximum Endothermic Peak Temperature (Melting Point) or Onset Temperature of Crystalline Resin or External Toner Additive The maximum endothermic peak temperature (melting point) or onset temperature is measured in accordance with ASTM D3418-82 using a "Q1000" differential scanning calorimeter (TA Instruments). The melting points of indium and zinc are used for temperature correction of the device detection part, and the heat of fusion of indium is used for correction of the calorific value.

Specifically, 5 mg of sample (external additive, crystalline resin) weighed precisely into an aluminum pan, and using an empty aluminum pan for reference, measurement during the first temperature rise is performed within a measurement temperature range from 30° C. to 200° C. at a ramp rate of 10° C./min. A DSC curve obtained during this first temperature rise is used to determine the physical properties specified by the present invention.

In this DSC curve, the temperature at the maximum endothermic peak in the DSC curve within the temperature range from 30° C. to 200° C. is given as the melting point of the sample. Furthermore, the rising temperature on the low-temperature side relative to the baseline of the maximum endothermic peak is given as the onset temperature T1 (° C.).

Method for Measuring Number-Average Particle Diameters of Primary Particles of Resin Particle, Inorganic Fine Particle and External Toner Additive The number-average particle diameter is measured using a ZETASIZER NANO-ZS (Malvern Panalytical Ltd.). This apparatus measures particle diameter by the dynamic light scattering method. The sample to be measured is first diluted to a solid-liquid ratio of 0.10 mass % (±0.02 mass %), collected in a quartz cell, and placed in the measurement part. Water or a methyl ethyl ketone/methanol mixed solvent is used as the dispersion medium when the sample is the inorganic fine particle, and water when the sample is the resin particle or external additive. The refractive index of the sample and the refractive index, viscosity and temperature of the dispersion solvent are input into the Zetasizer Software 6.30 control software as measurement conditions prior to measurement. The Dn is taken as the number-average particle diameter.

The refractive index of the inorganic fine particle is taken from the "Refractive indices of solids" described on page 517, Vol. II of the Chemical Handbook, Basic Edition of the Revised 4th edition (Ed. Chemical Society of Japan, Maruzen Publishing Co., Ltd). For the refractive index of the resin particle, the refractive index stored in the control software is used as the refractive index of the resin used in the resin particle. However, if no refractive index is stored in the control software the value described in the polymer database of the National Institute for Materials Science is used. The refractive index of the external additive is calculated by weight averaging the refractive index of the inorganic fine particle and the refractive index of the resin used in the resin particle. The values stored in the control software are selected for the refractive index, viscosity and temperature of the dispersion medium. In the case of a mixed solvent, the values of the mixed dispersion media are weight averaged.

Measuring Acid Value of Crystalline Resin

The acid value is the number of mg of potassium hydroxide required to neutralize the acid contained in 1 g of sample. The acid value is measured in accordance with JIS K 0070-1992, and specifically is measured by the following procedures.

(1) Reagent Preparation 1.0 g of phenolphthalein is dissolved in 90 mL of ethyl alcohol (95 vol %), and ion-exchange water is added to a total of 100 mL to obtain a phenolphthalein solution.

7 g of special-grade potassium hydroxide is dissolved in 5 mL of water, and ethyl alcohol (95 vol %) is added to a total of 1 L. Taking care to avoid contact with carbon dioxide and the like, this is placed in an alkali resistant container, left standing for 3 days, and filtered to obtain a potassium hydroxide solution. The resulting potassium hydroxide solution is stored in an alkali-resistant container. The factor of the potassium hydroxide solution is obtained by placing 25 mL of 0.1 mol/L hydrochloric acid in a triangular flask, adding several drops of the phenolphthalein solution, titrating this with the potassium hydroxide solution, and determining the amount of the potassium hydroxide solution required for neutralization. The 0.1 mol/L hydrochloric acid is prepared in accordance with JIS K 8001-1998.

(2) Operations (A) Main Test 2.0 g of pulverized crystalline resin is weighed precisely into a 200 mL triangular flask, 100 mL of a toluene/ethanol (2:1) mixed solution is added, and the sample is dissolved over the course of 5 hours. Several drops of the phenolphthalein solution are then added as an indicator, and this is titrated with the potassium hydroxide solution. Titration is considered to be complete when the light red color of the indicator persists for about 30 seconds.

(B) Blank Test

Titration is performed by the same operations but without a sample (using only a mixed toluene/ethanol (2:1) solution).

(3) The Test Results are Entered into the Following Formula to Calculate the Acid Value.

$$A=[(C-B)\times f\times 5.61]/S$$

In the formula, A is the acid value (mgKOH/g), B is the amount added (ml) of the potassium hydroxide solution in the blank test, C is the amount added (ml) of the potassium hydroxide solution in the main test, f is the factor of the potassium hydroxide solution, and S is the sample (g).

Measuring from Toner 100 g of the toner is weighed exactly, and dispersed in 1000 mL of water to which 1 mg of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) has been added. The dispersion is exposed to ultrasound, and treated at a specific strength in a centrifuge to separate and dry the supernatant. This is then observed at a magnification of 200,000 with a scanning electron microscope (SEM) "S-4800" (Hitachi, Ltd.) to confirm that only the external additive is present in the visual field.

The isolated external additive is dissolved in THF, and resin derived from the resin particle is extracted. The acid value of the resin derived from the resin particle is measured in the same way as the acid value of the crystalline resin above.

Method for Measuring Molecular Weight

The number average molecular weight Mn of the crystalline resin is measured as follows by gel permeation chromatography (GPC).

First, the crystalline resin is dissolved in toluene at 50° C. over the course of 24 hours. The resulting solution is then filtered with a solvent-resistant membrane filter "MAISHORI DISK" (Tosoh Corporation) having a pore diameter of 0.2 μm to obtain a sample solution. The concentration of toluene-soluble components in the sample solution is adjusted to about 0.8 mass %. Measurement is performed under the following conditions using this sample solution.

Equipment: HLC8120 GPC (detector: RI) (Tosoh Corporation)

Columns: Shodex KF-801, 802, 803, 804, 805, 806, 807 (total 7) (Showa Denko K. K.)

Eluent: Toluene

Flow rate: 1.0 mL/min

Oven temperature: 50.0° C.

Sample injection volume: 0.10 mL

A molecular weight calibration curve prepared using standard polystyrene resin (product name "TSK standard polystyrene F-850, F-450, F-288, F-128, F-80, F-40, F-20, F-10, F-4, F-2, F-1, A-5000, A-2500, A-1000, A-500", Tosoh Corporation) is used for calculating the molecular weights of the samples.

Method for Measuring Hydrophobicity of Inorganic Fine Particle

This is determined from a methanol chip permeability curve obtained as follows.

First, 70 mL of water is placed in a cylindrical glass container 1.75 mm thick and 5 cm in diameter, and dispersed for 5 minutes with an ultrasound disperser to remove air bubbles and the like.

Next, 0.1 g of the inorganic fine particle is weighed exactly and added to the container with the water to prepare a sample liquid for measurement.

The sample liquid for measurement is then set in a "WET-100P" powder wettability tester (Rhesca Co., Ltd.).

This sample liquid for measurement is stirred at a speed of 6.7 $s^{-1}$ (400 rpm) with a magnetic stirrer. A 25 mm-long spindle rotor with a maximum bore of 8 mm coated with fluorine resin is used as the rotor of the magnetic stirrer.

Figure 2:
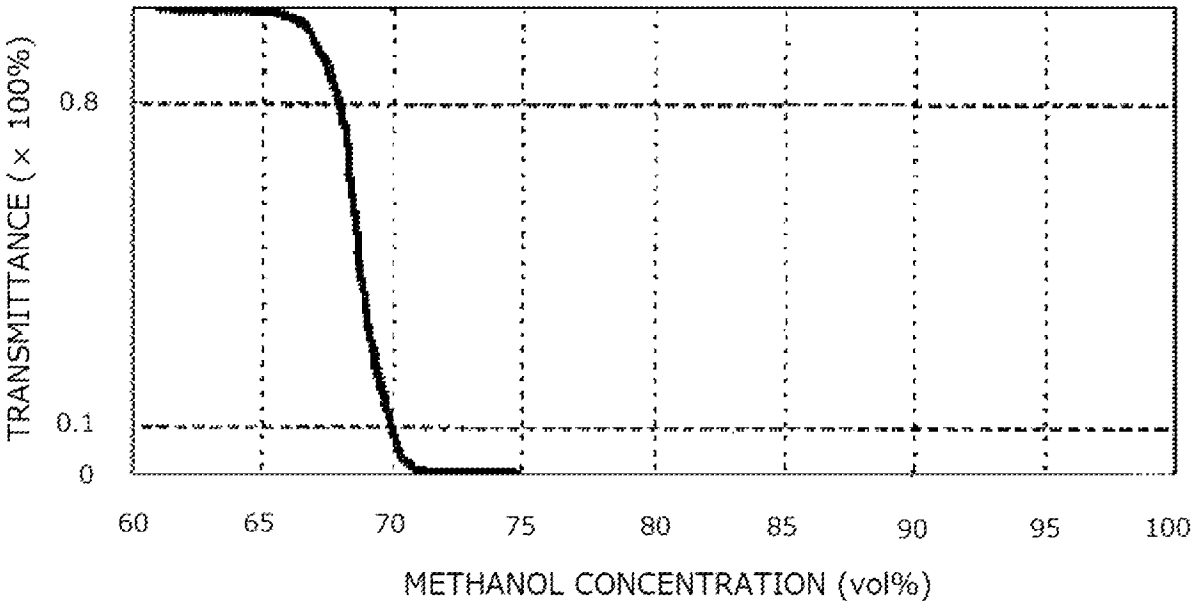
FIG. 2 is a graph showing transmittance against methanol concentration.

Next, methanol is dripped continuously at a rate of 1.3 mL/min through the aforementioned unit into the sample liquid for measurement as light transmittance is measured at a wavelength of 780 nm, and a methanol drip permeability curve is prepared as shown in FIG. 2.

The methanol concentration when transmittance reaches 50% of transmittance at the start of dripping is taken as the degree of hydrophobicity.

Method for Measuring Weight-Average Particle Diameter (D4) of Toner Particle

The weight-average particle diameter (D4) of the toner particle is calculated as follows. A "COULTER COUNTER MULTISIZER 3" (registered trademark, Beckman Coulter, Inc.) precision particle size distribution measurement device based on the pore electrical resistance method and equipped with a 100 μm aperture tube is used as the measurement device. The "Beckman Coulter's Multisizer 3 Version 3.51" dedicated software (Beckman Coulter, Inc.) attached to the device is used to set the measurement conditions and analyze the measurement data. Measurement is performed with 25,000 effective measurement channels.

A solution of special-grade sodium chloride dissolved to a concentration of about 1 mass % in ion-exchange water, such as "ISOTON II" (Beckman Coulter, Inc.), may be used as the electrolytic solution for measurement.

The following settings are performed on the dedicated software prior to measurement and analysis.

On the "Change standard operating method (SOM)" screen of the dedicated software, the total count in control mode is set to 50,000 particles, the number of measurements to one, and the Kd value to a value obtained using "Standard Particles 10.0 μm" (Beckman Coulter, Inc.). The threshold and noise level are set automatically by pressing the "threshold/noise level measurement button". The current is set to 1600 μA, the gain to 2, and the electrolytic solution to Isoton II, and a check is entered for "aperture tube flush after measurement".

On the "Conversion setting from pulse to particle diameter" screen of the dedicated software, the bin interval is set to the logarithmic particle diameter, the particle diameter bin is set to 256 particle diameter bin, and the particle diameter range is set to 2 μm to 60 μm.

The specific measurement methods are as follows.

(1) About 200 mL of the aqueous electrolytic solution is placed in a 250 mL glass round-bottomed beaker dedicated to the Multisizer 3, set on a sample stand, and stirred with a stirrer rod counterclockwise at a rate of 24 rotations/second. Contamination and bubbles in the aperture tube are removed by means of the "Aperture flush" function of the analytical software.

(2) Approximately 30 mL of the aqueous electrolytic solution is placed in a 100 mL glass flat-bottom beaker, and approximately 0.3 mL of a diluted solution of "CONTAMINON N" (a 10 mass % aqueous solution of a pH 7 neutral detergent for washing precision measurement equipment, comprising a nonionic surfactant, an anionic surfactant and an organic builder, made by Wako Pure Chemical Industries, Ltd.) diluted 3 times by mass with ion exchange water is added thereto as a dispersant.

(3) About 3.3 L of ion-exchange water is placed in the water bath of an "Ultrasonic Dispersion System Tetora 150" (Nikkaki Bios Co., Ltd) ultrasonic disperser with an electric output of 120 W in which two oscillators with an oscillation frequency of 50 kHz are built-in with the phases of the oscillators shifted by 180° to one other, and about 2 mL of the CONTAMINON N is added to the water bath.

(4) The beaker of (2) is set in a beaker-fixing hole of the ultrasonic disperser, and the ultrasonic disperser is operated. The height position of the beaker is adjusted so as to maximize the resonance state of the surface of the electrolytic solution in the beaker.

(5) The aqueous electrolytic solution in the beaker of (4) is exposed to ultrasound waves as approximately 10 mg of the toner is added little by little to the aqueous electrolytic solution and dispersed. Ultrasonic dispersion treatment is then continued for a further 60 seconds. During the ultrasonic dispersion, the temperature of the water in the water bath is adjusted as necessary so as to be from 10° C. to 40° C.

(6) Using a pipette, the electrolytic solution of (5) with the toner particle dispersed therein is dripped in to the round-bottom beaker of (1) disposed on the sample stand, and the measurement concentration is adjusted to about 5%. Measurement is then performed until the number of measured particles reaches 50,000.

(7) The measurement data is analyzed with the dedicated software attached to the apparatus, and the weight-average particle diameter (D4) is calculated. The weight-average particle diameter (D4) is the "average diameter" on the "Analysis/volume statistical value (arithmetic average)" screen when graph/vol % is set by the dedicated software.

Method for Measuring pKa 0.100 g of the neutralizing agent is weighed exactly into a 250 mL tall beaker, 150 mL, of water is added, and the mixture is dissolved for 30 minutes to prepare an aqueous neutralizing agent solution. A pH electrode is placed in the aqueous neutralizing agent solution to read the pH of the aqueous solution of the sample. A 0.1 mole/L ethyl alcohol solution of potassium hydroxide (Kishida Chemical Co., Ltd.) is added in 10 μL increments to the aqueous neutralizing agent solution, and the pH is read and titration performed each time. The 0.1 mole/L ethyl alcohol solution of potassium hydroxide is added until the pH reaches 14 or more and there is no further change in pH even when 30 μL is added.

Based on the results, the pH is plotted against the amount added of the 0.1 mole/L ethyl alcohol solution of potassium hydroxide to obtain a titration curve. Based on the titration curve, the point where the pH change gradient is the greatest is defined as the neutralization point, and the pH value at the neutralization point is given as the pKa.

Method for Measuring Toner Agglomeration

For the measurement equipment, a "POWDER TESTER" (Hosokawa Micron Corporation) was used with a digital display vibration meter "DIGI-VIBRO Model 1332A" (Showa Sokki Corporation) attached to the side of the vibrating stand. A sieve with a mesh size of 38 μm (400 mesh), a sieve with a mesh size of 75 μm (200 mesh) and a sieve with a mesh size of 150 μm (100 mesh) were then set in that order from bottom to top on the vibrating stand of the Powder Tester.

(1) The vibration amplitude of the vibrating stand was adjusted in advance so that the displacement value of the digital display vibration meter was 0.60 mm (peak-to-peak).

(2) 5 g of toner that had been left for 24 hours in a 23° C., 60% RH environment were weighed exactly, and gently placed on the uppermost 150 μm mesh sieve.

(3) The sieve was vibrated for 15 seconds, the mass of the toner remaining on each sieve was measured, and agglomeration was calculated based on the following formula.

(Agglomeration (%))={(mass (g) of sample on 150 μm mesh sieve)/5 (g)}×100+{(mass (g) of sample on 75 μm mesh sieve)/5 (g)}×100×0.6+{(mass (g) of sample on 38 μm mesh sieve)/5 (g)}×100×0.2

Method for Measuring Powder Dynamic Viscoelasticity

A DMA8000 (PerkinElmer Inc.) is used as the measurement device. Measurement is performed using a single cantilever (product No. N533-0300) with an N533-0267 oven.

About 50 mg of the toner is first weighed exactly, and loaded into the accessory material pocket (product No. N533-0322) so that the toner is in the center. A fixing jig is then attached to the geometry shaft so that the fixing jig straddles the temperature sensor and the distance between the drive shaft and the fixing jig is 18.0 mm. The material pocket containing the toner is then clamped with the fixing jig so that center of the pocket is centered with the fixing jig and the drive shaft, and the sample is measured.

The measurement conditions are set as follows using the measurement wizard.

Oven: Standard Air Oven
Measurement type: Temperature scan
Deformation mode: Single cantilever
Frequency: Single frequency 1 Hz
Amplitude: 0.05 mm
Heating speed: 2° C./min
Initial temperature: 30° C.
Final temperature: 180° C.
Cross-section: Rectangle
Dimensions of test piece: 17.5 mm (length)×7.5 mm (width)×1.5 mm (thickness)
Data collection interval: 0.3 second interval In a temperature T [° C.]-storage elastic modulus E' [Pa] curve obtained by powder dynamic viscoelasticity measurement of the toner, the change in the storage elastic modulus E' relative to the temperature T (dE'/dT) is measured for about 1.5 seconds before and after each temperature.

The change (dE'/dT) is measured within a temperature range between the onset temperature and 90° C. by the above method, and a temperature [° C.]-change (dE'/dT) graph is prepared skipping two points from the initial data in each plot. The minimum values in this graph at not more than $-1.0\times10^7$ are measured, and the minimum value that appears first at the low-temperature end is calculated.

EXAMPLES

The present invention is explained in more detail below with reference to Examples and Comparative Examples, but the present invention is not limited to these. Unless otherwise specified, parts and percentages referring to the materials below are based on mass.

Manufacturing Example of Crystalline Resin 1

Decanedicarboxylic acid 159.0 parts
1,6-hexanediol 90.0 parts
Trimellitic acid 5.0 parts These materials were loaded into a reaction vessel equipped with a stirrer, a thermometer and a nitrogen inlet tube. 0.1 part of tetraisobutyl titanate was then added relative to the total amount of these raw materials, and the mixture was reacted for 4 hours at 180° C., heated to 210° C. at a rate of 10° C./hour, maintained for 8 hours at 210° C., and then reacted for 1 hour at 8.3 kPa to obtain a crystalline resin 1. The physical properties of the crystalline resin 1 are shown in Table 1.

Manufacturing Examples of Crystalline Resins 2 to 9

Crystalline resins 2 to 9 were obtained by altering the monomer formulation and adjusting the reaction conditions from the manufacturing example of crystalline resin 1 as shown in Table 1. The physical properties of the crystalline resins 2 to 9 are shown in the Table 1.

TABLE 1

| Crystalline resin No. | A | B | C | D | E | F | Melting point [° C.] | Onset temperature T1 [° C.] | Acid value | Number average molecular weight | Weight-average molecular weight |
|---|---|---|---|---|---|---|---|---|---|---|---|
| 1 | 159.0 | | | | 60.0 | 5.0 | 66.0 | 63.0 | 10.0 | 18000 | 38000 |
| 2 | | 159.0 | | | 60.0 | 5.0 | 59.0 | 56.0 | 10.5 | 18000 | 38000 |
| 3 | | | 159.0 | | 60.0 | 5.0 | 105.0 | 102.0 | 10.8 | 18000 | 38000 |
| 4 | 159.0 | | | | 60.0 | 1.0 | 63.0 | 60.0 | 3.0 | 18000 | 38000 |
| 5 | 159.0 | | | | 60.0 | 2.5 | 64.0 | 61.0 | 7.0 | 18000 | 38000 |
| 6 | 159.0 | | | | 60.0 | 10.0 | 65.0 | 62.0 | 25.0 | 18000 | 38000 |
| 7 | 159.0 | | | | 63.0 | 5.0 | 66.0 | 63.0 | 10.0 | 9000 | 18000 |
| 8 | 159.0 | | | | 57.0 | 5.0 | 66.0 | 63.0 | 10.0 | 36000 | 76000 |
| 9 | | 159.0 | | 60.0 | | 5.0 | 49.0 | 46.0 | 10.0 | 15000 | 30000 |

In the table,
the acid values are shown in units of mgKOH/g,
"A" represents "Decanedicarboxylic acid",
"B" represents "Sebacic acid",
"C" represents "Terephthalic acid",
"D" represents "1,4-butanediol",
"E" represents "1,6-hexanediol", and
"F" represents "Trimellitic acid".

Manufacturing Example of Amorphous Resin 1

| | |
|---|---|
| Bisphenol A propylene oxide adduct (2.2 mol adduct) | 60.0 parts |
| Bisphenol A ethylene oxide adduct (2.2 mol adduct) | 40.0 parts |
| Terephthalic acid | 77.0 parts |

This polyester monomer mixture was loaded into a 5-liter autoclave together with 0.2 part of dibutyl tin oxide relative to the total monomers, a reflux cooler, moisture separator, $N_2$ gas inlet tube, thermometer and stirrer were attached to the autoclave, and nitrogen gas was introduced into the autoclave as a polycondensation reaction was performed at 230° C. The reaction time was adjusted to obtain the desired softening point, and after completion of the reaction the product was removed from the vessel, cooled, and pulverized to obtain an amorphous resin 1 (glass transition temperature Tg: 59° C., softening point Tm: 112° C.).

Manufacturing Example of Hydrophobic Agent Solution 1

0.1 part of dimethyl disilazane was dissolved in 1.0 part of isopropyl alcohol to obtain a hydrophobic agent solution 1.

Neutralizing Agent

The neutralizing agents shown in Table 2 were prepared. The pKa values and boiling points are shown in Table 2.

TABLE 2

| | Type | pKa | Boiling point [° C.] |
|---|---|---|---|
| Neutralizing agent 1 | Triethylamine | 10.8 | 90 |
| Neutralizing agent 2 | Ammonia water | 9.3 | −33 |
| Neutralizing agent 3 | Hydroxylamine | 6.0 | 58 |
| Neutralizing agent 4 | Dimethylaminoethanol | 9.2 | 133 |
| Neutralizing agent 5 | Triethanolamine | 7.8 | 208 |
| Neutralizing agent 6 | Butylamine | 12.5 | 78 |

Inorganic Fine Particle Dispersion

Commercial inorganic fine particle dispersions were purchased for the inorganic fine particle dispersion. The inorganic fine particle dispersions were solidified by drying, and the solids contents were measured from the change in weight after drying. The inorganic fine particle aggregate obtained by solidification was pulverized in a freeze pulverizer, and thoroughly dried and crushed to obtain an inorganic fine particle. A wettability test of this inorganic fine particle with methanol was performed to measure hydrophobicity. The number-average particle diameter, hydrophobicity, and solids content are shown in Table 3. The dispersion medium of the inorganic fine particle dispersions 1 to 3 is water. The dispersion medium of the inorganic fine particle dispersion 4 is a mixed solvent of methyl ethyl ketone/methanol=98 mass %/2 mass %.

TABLE 3

| | Type | Number average particle diameter of primary particle [nm] | Hydrophobicity [methanol vol %] | Solids content [mass %] | Dispersion medium [mass %] | Molecular weight of inorganic fine particle |
|---|---|---|---|---|---|---|
| Inorganic fine particle dispersion 1 | ST-30 (Nissan Chemical Industries, Ltd.) | 15 | 30 | 30 | Water | 60 |
| Inorganic fine particle dispersion 2 | ST-30L (Nissan Chemical Industries, Ltd.) | 50 | 30 | 30 | Water | 60 |
| Inorganic fine particle dispersion 3 | ST-ZL (Nissan Chemical Industries, Ltd.) | 100 | 40 | 40 | Water | 60 |
| Inorganic fine particle dispersion 4 | MEK-ST-40 (Nissan Chemical Industries, Ltd.) | 15 | 40 | 40 | MEK/MeOH = 98/2 | 60 |

In the table, MEK represents methyl ketone and MeOH represents methanol.

Manufacturing Example of Resin Particle Dispersion 1

5.0 parts of the crystalline resin 1 and 10.0 parts of THF were loaded into a reaction vessel equipped with a stirrer, a condenser and a thermometer, and heated and dissolved at 50° C.

0.5 part of triethylamine were then added under stirring as neutralizing agent 1. After thorough dissolution of the resin had been confirmed, 75 parts of water were dripped in at a rate of 2.5 g/minute to perform phase inversion emulsification, and the THF was thoroughly distilled off with an evaporator at 40° C.

Ultrafiltration was then performed to remove excess neutralizing agent, and concentration/filtration was repeated for a total of 5 times. Water was then added under ultrasound, to obtain a resin particle dispersion 1 (solids concentration 5.0 mass %). The number-average particle diameter was 190 nm as measured with a Zetasizer.

Manufacturing Examples of Resin Particle Dispersions 2 to 14

The resin particle dispersions 2 to 14 were obtained as in the manufacturing example of resin particle dispersion 1 except that the crystalline resin and neutralizing agent were changed as shown in Table 4. The physical properties are shown in Table 4.

Manufacturing Example of Resin Particle Dispersion 15

5.0 parts of the crystalline resin 1 and 15.0 parts of toluene were loaded into a reaction vessel equipped with a stirrer, a condenser and a thermometer, and heated and dissolved at 50° C. to prepare a crystalline resin solution 1. This crystalline resin solution 1 was added to a water phase obtained by dissolving 0.2 part of sodium dodecyl sulfonate in 100 parts of water, and dispersed for 10 minutes at 12,000 rpm with a T50 Ultra-Turrax rotary homogenizer (IKA).

The toluene was thoroughly distilled off with an evaporator at 40° C. Water was then added under ultrasound to obtain a resin particle dispersion 15 (solids concentration 5.0 mass %). The number-average particle diameter was 130 nm as measured with a Zetasizer.

TABLE 4

| | Crystalline resin | Neutralizing agent | Number-average particle diameter [nm] |
|---|---|---|---|
| Resin particle dispersion 1 | Crystalline resin 1 | Neutralizing agent 1 | 190 |
| Resin particle dispersion 2 | Crystalline resin 2 | Neutralizing agent 1 | 171 |
| Resin particle dispersion 3 | Crystalline resin 3 | Neutralizing agent 1 | 228 |
| Resin particle dispersion 4 | Crystalline resin 4 | Neutralizing agent 1 | 333 |
| Resin particle dispersion 5 | Crystalline resin 5 | Neutralizing agent 1 | 266 |
| Resin particle dispersion 6 | Crystalline resin 6 | Neutralizing agent 1 | 143 |
| Resin particle dispersion 7 | Crystalline resin 7 | Neutralizing agent 1 | 95 |
| Resin particle dispersion 8 | Crystalline resin 8 | Neutralizing agent 1 | 333 |
| Resin particle dispersion 9 | Crystalline resin 1 | Neutralizing agent 2 | 181 |
| Resin particle dispersion 10 | Crystalline resin 1 | Neutralizing agent 3 | Aggregated |
| Resin particle dispersion 11 | Crystalline resin 1 | Neutralizing agent 4 | 209 |
| Resin particle dispersion 12 | Crystalline resin 1 | Neutralizing agent 5 | 266 |
| Resin particle dispersion 13 | Crystalline resin 1 | Neutralizing agent 6 | 304 |
| Resin particle dispersion 14 | Crystalline resin 9 | Neutralizing agent 1 | 171 |

Manufacturing Example of External Additive 1

10.0 parts of the resin particle dispersion 1 and 3.0 parts of the inorganic fine particle dispersion 1 were added to a vessel equipped with a stirrer, a condenser and a thermometer, and thoroughly stirred to prepare a co-dispersion 1. The pH of the co-dispersion 1 was 10.8 as measured with a LAQUA twin pH-11B (Horiba, Ltd.).

0.1 N hydrochloric acid was then dripped into the co-dispersion 1 to adjust the pH to 9.0. The temperature T2 was set to 40° C. as the heating condition during pH adjustment, and the liquid temperature was confirmed to have stabilized. In order to accumulate the inorganic fine particles on the surface of the resin particle, 0.1 N hydrochloric acid was next dripped into the co-dispersion 1 as the pH was adjusted to 2.0. This was then exposed to ultrasound for 10 minutes to obtain an external additive dispersion 1.

1.0 part of the hydrophobic agent solution 1 was then added to the external additive dispersion 1, and stirred for 2 hours at 30.0° C. This was then centrifuged for 10 minutes at 12,000 rpm, and the precipitate was collected and vacuum dried to obtain an external additive 1. The Za, Za/Zb, SF-2 and number-average particle diameter of the external additive 1 were measured. The physical properties are shown in Table 6.

Manufacturing Examples of External Toner Additives 2 to 36

External toner additives 2 to 36 were obtained as in the manufacturing example of the external additive 1 except that the type and amount added of the resin particle dispersion, the type and amount added of the inorganic fine particle dispersion, the pH before and after accumulation of the inorganic fine particle, and the temperature T2 were changed as shown in Table 5. The physical property values are shown in Table 6.

TABLE 5

| | Resin particle dispersion | | | Inorganic fine particle dispersion | | | Parts of inorganic fine particle | | pH | | Heating during inorganic fine particle accumulation | |
|---|---|---|---|---|---|---|---|---|---|---|---|---|
| External additive No. | No. | Parts | Ry nm | No. | Parts | Rx nm | per 100 parts of resin particle | Ry/Rx | Before inorganic fine particle accumulation | After inorganic fine particle accumulation | T2 [° C.] | T2 − T1 [° C.] |
| 1 | 1 | 10.0 | 190 | 1 | 3.0 | 15 | 40 | 12.7 | 9.0 | 2.0 | 40 | −23 |
| 2 | 2 | 10.0 | 171 | 1 | 3.0 | 15 | 40 | 11.4 | 9.0 | 2.0 | 29 | −27 |
| 3 | 3 | 10.0 | 228 | 1 | 3.0 | 15 | 40 | 15.2 | 9.0 | 2.0 | 77 | −25 |
| 4 | 1 | 10.0 | 190 | 2 | 3.0 | 50 | 40 | 3.8 | 9.0 | 2.0 | 40 | −23 |
| 5 | 1 | 10.0 | 190 | 3 | 2.3 | 100 | 40 | 1.9 | 9.0 | 2.0 | 40 | −23 |
| 6 | 15 | 10.0 | 190 | 1 | 3.0 | 15 | 40 | 12.7 | 9.0 | 2.0 | 40 | −23 |
| 7 | 4 | 10.0 | 333 | 1 | 3.0 | 15 | 40 | 22.2 | 9.0 | 2.0 | 40 | −20 |
| 8 | 5 | 10.0 | 266 | 1 | 3.0 | 15 | 40 | 17.7 | 9.0 | 2.0 | 40 | −21 |
| 9 | 6 | 10.0 | 143 | 1 | 3.0 | 15 | 40 | 9.5 | 9.0 | 2.0 | 40 | −22 |
| 10 | 7 | 10.0 | 95 | 1 | 3.0 | 15 | 40 | 6.3 | 9.0 | 2.0 | 40 | −23 |
| 11 | 8 | 10.0 | 333 | 1 | 3.0 | 15 | 40 | 22.2 | 9.0 | 2.0 | 40 | −23 |
| 12 | 9 | 10.0 | 181 | 1 | 3.0 | 15 | 40 | 12.1 | 9.0 | 2.0 | 40 | −23 |
| 13 | 11 | 10.0 | 209 | 1 | 3.0 | 15 | 40 | 13.9 | 9.0 | 2.0 | 40 | −23 |
| 14 | 12 | 10.0 | 266 | 1 | 3.0 | 15 | 40 | 17.7 | 9.0 | 2.0 | 40 | −23 |
| 15 | 13 | 10.0 | 304 | 1 | 3.0 | 15 | 40 | 20.3 | 9.0 | 2.0 | 40 | −23 |
| 16 | 1 | 10.0 | 190 | 1 | 1.7 | 15 | 22 | 12.7 | 9.0 | 2.0 | 40 | −23 |
| 17 | 1 | 10.0 | 190 | 1 | 1.4 | 15 | 18 | 12.7 | 9.0 | 2.0 | 40 | −23 |
| 18 | 1 | 10.0 | 190 | 1 | 4.4 | 15 | 58 | 12.7 | 9.0 | 2.0 | 40 | −23 |
| 19 | 1 | 10.0 | 190 | 1 | 4.7 | 15 | 62 | 12.7 | 9.0 | 2.0 | 40 | −23 |
| 20 | 1 | 10.0 | 190 | 1 | 5.9 | 15 | 78 | 12.7 | 9.0 | 2.0 | 40 | −23 |
| 21 | 1 | 10.0 | 190 | 1 | 3.0 | 15 | 40 | 12.7 | 9.0 | 2.0 | 50 | −13 |
| 22 | 1 | 10.0 | 190 | 1 | 3.0 | 15 | 40 | 12.7 | 9.0 | 2.0 | 80 | 17 |
| 23 | 1 | 10.0 | 190 | 1 | 3.0 | 15 | 40 | 12.7 | 9.0 | 2.8 | 40 | −23 |
| 24 | 1 | 10.0 | 190 | 1 | 3.0 | 15 | 40 | 12.7 | 9.0 | 3.2 | 40 | −23 |
| 25 | 1 | 10.0 | 190 | 1 | 3.0 | 15 | 40 | 12.7 | 7.0 | 2.0 | 40 | −23 |
| 26 | 1 | 10.0 | 190 | 1 | 3.0 | 15 | 40 | 12.7 | 7.0 | 2.8 | 40 | −23 |

TABLE 5-continued

| External additive No. | Resin particle dispersion No. | Resin particle dispersion Parts | Resin particle dispersion Ry nm | Inorganic fine particle dispersion No. | Inorganic fine particle dispersion Parts | Inorganic fine particle dispersion Rx nm | Parts of inorganic fine particle per 100 parts of resin particle | Ry/Rx | pH Before inorganic fine particle accumulation | pH After inorganic fine particle accumulation | Heating during inorganic fine particle accumulation T2 [° C.] | Heating during inorganic fine particle accumulation T2 − T1 [° C.] |
|---|---|---|---|---|---|---|---|---|---|---|---|---|
| 27 | 1 | 10.0 | 190 | 1 | 3.0 | 15 | 40 | 12.7 | 7.0 | 3.2 | 40 | −23 |
| 28 | 1 | 10.0 | 190 | 1 | 3.0 | 15 | 40 | 12.7 | 5.0 | 2.0 | 40 | −23 |
| 29 | 1 | 10.0 | 190 | 1 | 3.0 | 15 | 40 | 12.7 | 5.0 | 2.8 | 40 | −23 |
| 30 | 1 | 10.0 | 190 | 1 | 3.0 | 15 | 40 | 12.7 | 9.0 | 5.0 | 40 | −23 |
| 31 | 1 | 10.0 | 190 | 1 | 3.0 | 15 | 40 | 12.7 | 9.0 | 9.0 | 40 | −23 |
| 32 | 1 | 10.0 | 190 | 1 | 3.0 | 15 | 40 | 12.7 | 9.0 | 2.0 | 20 | −43 |
| 33 | 1 | 10.0 | 190 | 1 | 3.0 | 15 | 40 | 12.7 | 9.0 | 2.0 | 0 | −63 |
| 34 | 1 | 10.0 | 190 | 1 | 3.0 | 15 | 40 | 12.7 | 9.0 | 2.0 | 100 | 37 |
| 35 | 1 | 10.0 | 190 | 1 | 6.2 | 15 | 82 | 12.7 | 9.0 | 2.0 | 40 | −23 |
| 36 | 14 | 10.0 | 171 | 1 | 3.0 | 15 | 40 | 11.4 | 9.0 | 2.0 | 45 | −1 |
| 37 | — | — | 181 | 4 | — | 15 | 80 | 12.1 | — | — | — | — |
| 38 | 17 | — | 181 | — | — | 15 | 40 | 12.1 | — | — | — | — |
| 39 | — | — | 171 | — | — | 15 | 40 | 11.4 | — | — | — | — |
| 40 | 19 | — | 152 | — | — | — | — | — | — | — | — | — |

Manufacturing Example of External Additive 37

5.0 parts of the crystalline resin 1 and 10.0 parts of THF were loaded into a vessel equipped with a stirrer, a condenser and a thermometer, and heated and dissolved at 50° C. 3.0 parts of the inorganic fine particle dispersion 4 were then added.

Next, 0.5 part of triethylamine (neutralizing agent 1) were added under stirring. After thorough dissolution of the resin and dispersion of the inorganic fine particle had been confirmed, 75 parts of water were dripped in at a rate of 2.5 g/minute to perform phase inversion emulsification, and the THF was thoroughly distilled off with an evaporator at 40° C. to obtain an external additive dispersion 16 (solids concentration 5.0 mass %).

1.0 part of the hydrophobic agent solution 1 was then added to the external additive dispersion 16, and stirred for 2 hours at 30.0° C. This was then centrifuged for 10 minutes at 12,000 rpm, and the precipitate was collected and vacuum dried to obtain an external additive 37. The physical properties are shown in Table 6.

Manufacturing Example of External Additive 38

3.0 parts of sodium dodecyl sulfonate (SDS) and 150.0 parts of water were added and dissolved in a vessel equipped with a stiffer, a condenser and a thermometer. 95.0 parts of styrene were then dripped in at a rate of 3.0 parts/minute to prepare an emulsion. The temperature of the emulsion was raised to 80° C., 0.6 part of potassium persulfate dissolved in 10.0 parts of water were added, and polymerization was performed for 2 hours.

The emulsion was then cooled to 40° C., 5.0 parts of divinyl benzene were added, and the mixture was stirred for 2 hours, after which the temperature was raised to 85° C. and 0.1 part of potassium persulfate dissolved in 2.0 parts of water was added, a polymerization reaction was performed for 4 hours, and an aqueous hydroquinone solution was added as a reaction terminator to complete polymerization. The polymer conversion rate at this point was 99%.

The water-soluble matter was removed by ultrafiltration, and the pH and concentration were adjusted to obtain a resin particle dispersion 17 with a solids concentration of 50% and a pH of 8.5.

The resulting 2.0 parts of the resin particle dispersion 17 were added to 100.0 parts of methanol, and 7.5 parts of tetraethoxysilane were dissolved in as a hydrophobic agent. This was heated as is to 50° C., and stirred for 1 hour. 20.0 parts of a 28 mass % aqueous $NH_4OH$ solution were then added with dripping to this solution, and stirred for 48 hours at room temperature to perform a sol-gel reaction and coat the surface of the resin particle with siloxane. After completion of the reaction, this was washed with water and then with methanol, filtered, and dried under reduced pressure of 40 kPa for 24 hours at 45° C.

The entire amount was then dispersed in 6.0 parts of toluene, 0.01 part of 3-aminopropyl triethoxysilane (silicon compound containing amino groups) was added, and the mixture was dispersed and mixed for 15 minutes. 0.01 part of hexamethyldisilazane was then added, and dispersed and mixed for 15 minutes to bring it into contact with the fine particle. This dispersion was vacuum distilled, and dried to obtain an external additive 38. The physical property values are shown in Table 6.

Manufacturing Example of External Additive 39

100.0 parts of wax (Hi-Wax 100P (Mitsui Chemicals, Inc., molecular weight 900, melting point 116° C., softening point 121° C.)), 900.0 parts of water and 2.0 parts of ethylene glycol monostearate were added to a vessel equipped with a stirrer, a condenser, a thermometer and a Clearmix (M Technique Co., Ltd.), and stirred at 90° C. This was then dispersed for 10 minutes with the Clearmix at a rotational speed of 10,000 rpm to obtain a wax fine particle dispersion. Next, the wax fine particle dispersion was cooled to 40° C., and vacuum dried at 25° C. in a vacuum dryer to obtain a wax fine particle.

100.0 parts of the wax fine particle and 20.0 parts of fumed silica (BET: 200 $m^2/g$) were mixed with a multipurpose mixer (MP5 (Nippon Coke & Engineering Co., Ltd.)) to attach the fumed silica to the surface of the wax fine particle and obtain an external additive 39. The physical property values are shown in Table 6.

Manufacturing Example of External Additive 40

100.0 parts of the crystalline resin 1, 50.0 parts of methyl ethyl ketone and 25.0 parts of 2-propanol were placed in a vessel provided with a stirrer, a condenser, a thermometer and a nitrogen inlet tube, and dissolved under thorough stirring at 50° C. 3.5 parts of 10 wt % aqueous ammonia solution were then added, and the mixture was stirred for at least 10 minutes to obtain a crystalline resin solution 2.

This was then heated to 72° C., and 1.0 part/minute of water was dripped into the crystalline resin solution 2 under stirring to perform phase inversion emulsification. After completion of water dripping, this was bubbled for 24 hours with dry nitrogen at 25° C. under stirring at 70 rpm to remove the solvent and obtain a resin particle dispersion 19. The total amount of this resin particle dispersion 19 was then freeze dried to obtain an external additive 40. The physical property values are shown in Table 6.

TABLE 6

| External additive No. | Za [Mass %] | Za/Zb | SF-2 | Tm [° C.] | Number-average particle diameter of primary particle [nm] | State of inorganic fine particle in surface layer of external additive |
|---|---|---|---|---|---|---|
| 1 | 25 | 1.3 | 130 | 66 | 200 | Embedded |
| 2 | 20 | 1.1 | 130 | 59 | 180 | Embedded |
| 3 | 20 | 1.1 | 125 | 105 | 240 | Embedded |
| 4 | 20 | 1.1 | 135 | 66 | 200 | Embedded |
| 5 | 20 | 1.1 | 140 | 66 | 200 | Embedded |
| 6 | 20 | 1.1 | 130 | 66 | 200 | Embedded |
| 7 | 20 | 1.1 | 120 | 66 | 350 | Embedded |
| 8 | 20 | 1.1 | 125 | 66 | 280 | Embedded |
| 9 | 20 | 1.1 | 130 | 66 | 150 | Embedded |
| 10 | 20 | 1.1 | 145 | 66 | 100 | Embedded |
| 11 | 20 | 1.1 | 130 | 66 | 350 | Embedded |
| 12 | 24 | 1.2 | 130 | 66 | 190 | Embedded |
| 13 | 22 | 1.3 | 130 | 66 | 220 | Embedded |
| 14 | 22 | 1.1 | 130 | 66 | 280 | Embedded |
| 15 | 22 | 1.1 | 130 | 66 | 320 | Embedded |
| 16 | 18 | 1.0 | 115 | 66 | 200 | Embedded |
| 17 | 16 | 0.8 | 110 | 66 | 200 | Embedded |
| 18 | 18 | 1.5 | 135 | 66 | 200 | Embedded |
| 19 | 18 | 1.7 | 140 | 66 | 200 | Embedded |
| 20 | 16 | 2.4 | 145 | 66 | 200 | Embedded |
| 21 | 24 | 1.3 | 130 | 66 | 200 | Embedded |
| 22 | 20 | 1.1 | 135 | 66 | 200 | Embedded |
| 23 | 20 | 1.2 | 120 | 66 | 200 | Embedded |
| 24 | 17 | 0.9 | 112 | 66 | 200 | Embedded |
| 25 | 20 | 1.2 | 120 | 66 | 200 | Embedded |
| 26 | 18 | 1.0 | 115 | 66 | 200 | Embedded |
| 27 | 17 | 0.9 | 112 | 66 | 200 | Embedded |
| 28 | 20 | 1.2 | 115 | 66 | 200 | Embedded |
| 29 | 18 | 1.0 | 110 | 66 | 200 | Embedded |
| 30 | 14 | 0.7 | 108 | 66 | 200 | Embedded |
| 31 | 20 | 1.1 | 105 | 66 | 200 | Embedded |
| 32 | 14 | 0.7 | 108 | 66 | 200 | Embedded |
| 33 | 13 | 0.6 | 105 | 66 | 200 | Embedded |
| 34 | 13 | 0.6 | 102 | 66 | 200 | Embedded |
| 35 | 20 | 3.0 | 155 | 66 | 180 | Embedded |
| 36 | 20 | 1.1 | 130 | 49 | 180 | Embedded |
| 37 | 15 | 0.6 | 125 | 66 | 190 | Embedded |
| 38 | 13 | 0.6 | 105 | — | 190 | Coating layer structure |
| 39 | 20 | 1.1 | 155 | 96 | 180 | Coating layer structure |
| 40 | 20 | 1.1 | 105 | 72 | 160 | Resin fine particle |

In the table, Tm represents the maximum endothermic peak temperature (° C.) during the first temperature rise in differential scanning calorimetry of the external additive.

Manufacturing Example of Toner Particle 1

100.0 parts of the amorphous resin 1 (Tg: 59° C., softening point Tm: 112° C.), 75.0 parts of magnetic iron oxide powder, 2.0 parts of Fischer-Tropsch wax (Sasol C105, melting point: 105° C.) and 2.0 parts of a charge control agent (Hodogaya Chemical Co., Ltd., T-77) were pre-mixed in an FM Mixer (Nippon Coke & Engineering Co., Ltd.), and then melt kneaded with a twin-screw extruder (product name: PCM-30, Ikegai Corp) with the temperature set so that the temperature of the molten material at the discharge port was 150° C.

The resulting kneaded product was cooled, coarsely pulverized in a hammer mill, and then finely pulverized in a pulverizer (product name: Turbo Mill T250, Freund-Turbo Corporation) and classified to obtain a toner particle 1 with a weight-average particle diameter (D4) of 7.2 μm.

Manufacturing Example of Toner 1

1.5 parts of the external additive 1 and 0.5 part of fumed silica (BET: 200 $m^2/g$) treated with hexamethyl disilazane were dry mixed for 5 minutes with 100.0 parts of the toner particle 1 in an FM Mixer (Nippon Coke & Engineering Co., Ltd.), and the externally added particles were then sieved with a 150 μm mesh sieve to obtain a toner 1. The physical properties are shown in Table 7.

Manufacturing Examples of Toners 2 to 40

Toners 2 to 40 were obtained as in the manufacturing example of toner 1 except that the external additive 1 was changed as shown in Table 7. The physical properties are shown in Table 7.

TABLE 7

| Toner No. | Toner particle No. | External additive type/ amount added [parts] | | | | Minimum of (dE'/dT) at lowest temperature end [$\times 10^7$] |
|---|---|---|---|---|---|---|
| 1 | 1 | External additive 1 | 1.5 | Fumed silica | 0.5 | −13.0 |
| 2 | 1 | External additive 2 | 1.5 | Fumed silica | 0.5 | −13.0 |
| 3 | 1 | External additive 3 | 1.5 | Fumed silica | 0.5 | −10.0 |
| 4 | 1 | External additive 4 | 1.5 | Fumed silica | 0.5 | −11.0 |
| 5 | 1 | External additive 5 | 1.5 | Fumed silica | 0.5 | −11.0 |
| 6 | 1 | External additive 6 | 1.5 | Fumed silica | 0.5 | −13.0 |
| 7 | 1 | External additive 7 | 1.5 | Fumed silica | 0.5 | −13.0 |
| 8 | 1 | External additive 8 | 1.5 | Fumed silica | 0.5 | −12.0 |
| 9 | 1 | External additive 9 | 1.5 | Fumed silica | 0.5 | −12.0 |
| 10 | 1 | External additive 10 | 1.5 | Fumed silica | 0.5 | −12.0 |
| 11 | 1 | External additive 11 | 1.5 | Fumed silica | 0.5 | −12.0 |
| 12 | 1 | External additive 12 | 1.5 | Fumed silica | 0.5 | −11.0 |
| 13 | 1 | External additive 13 | 1.5 | Fumed silica | 0.5 | −11.0 |
| 14 | 1 | External additive 14 | 1.5 | Fumed silica | 0.5 | −12.0 |
| 15 | 1 | External additive 15 | 1.5 | Fumed silica | 0.5 | −11.0 |
| 16 | 1 | External additive 16 | 1.5 | Fumed silica | 0.5 | −11.0 |
| 17 | 1 | External additive 17 | 1.5 | Fumed silica | 0.5 | −12.0 |
| 18 | 1 | External additive 18 | 1.5 | Fumed silica | 0.5 | −11.0 |
| 19 | 1 | External additive 19 | 1.5 | Fumed silica | 0.5 | −12.0 |
| 20 | 1 | External additive 20 | 1.5 | Fumed silica | 0.5 | −11.0 |
| 21 | 1 | External additive 21 | 1.5 | Fumed silica | 0.5 | −12.0 |
| 22 | 1 | External additive 22 | 1.5 | Fumed silica | 0.5 | −11.0 |
| 23 | 1 | External additive 23 | 1.5 | Fumed silica | 0.5 | −11.0 |
| 24 | 1 | External additive 24 | 1.5 | Fumed silica | 0.5 | −11.0 |
| 25 | 1 | External additive 25 | 1.5 | Fumed silica | 0.5 | −11.0 |
| 26 | 1 | External additive 26 | 1.5 | Fumed silica | 0.5 | −11.0 |
| 27 | 1 | External additive 27 | 1.5 | Fumed silica | 0.5 | −11.0 |
| 28 | 1 | External additive 28 | 1.5 | Fumed silica | 0.5 | −11.0 |
| 29 | 1 | External additive 29 | 1.5 | Fumed silica | 0.5 | −11.0 |
| 30 | 1 | External additive 30 | 1.5 | Fumed silica | 0.5 | −11.0 |
| 31 | 1 | External additive 31 | 1.5 | Fumed silica | 0.5 | −12.0 |
| 32 | 1 | External additive 32 | 1.5 | Fumed silica | 0.5 | −11.0 |
| 33 | 1 | External additive 33 | 1.5 | Fumed silica | 0.5 | −11.0 |
| 34 | 1 | External additive 34 | 1.5 | Fumed silica | 0.5 | −12.0 |
| 35 | 1 | External additive 35 | 1.5 | Fumed silica | 0.5 | −8.0 |
| 36 | 1 | External additive 36 | 1.5 | Fumed silica | 0.5 | −12.0 |
| 37 | 1 | External additive 37 | 1.5 | Fumed silica | 0.5 | −12.0 |
| 38 | 1 | External additive 38 | 1.5 | Fumed silica | 0.5 | −12.0 |
| 39 | 1 | External additive 39 | 1.5 | Fumed silica | 0.5 | −8.0 |
| 40 | 1 | External additive 40 | 1.5 | Fumed silica | 0.5 | −12.0 |

Example 1

The following evaluations were performed with the toner 1 using the main body of a commercial HP LaserJet Enterprise M606dn printer using a magnetic single-component system (Hewlett-Packard Company, process speed 350 mm/s), modified so that the process speed was 380 mm/s.

The process cartridge used in the evaluation is an 81X High Yield Black Original LaserJet Toner Cartridge (Hewlett-Packard Company). The toner product was removed from inside the designated process cartridge, which was then cleaned by air blowing, and filled with 1,200 g of the toner obtained in the example at a high density. Using this, the Toner 1 was then evaluated as follows. Vitality (Xerox Corporation, basis weight 75 g/cm$^2$, letter) was used as the evaluation paper.

Evaluation of Low-Temperature Fixability

The fixing unit was removed from the evaluation unit to obtain an external fixing unit on which the temperature could be set at will. Using this unit, with the fixing temperature controlled in 5° C. increments within the range from 170° C. to 220° C., halftone images are output with an image density from 0.60 to 0.65. The image density was measured using an SPI filter with a Macbeth Densitometer, a reflection densitometer (Macbeth Co.). The resulting image was rubbed 5 times back and forth with Silbon paper under 4.9 kPa of load, and the loss of image density after rubbing was measured.

The lowest fixing unit temperature setting at which the image density loss was not more than 10% was taken as the fixing initiation temperature of the toner, and used to evaluate low-temperature fixability according to the following standard. Toners with low fixing initiation temperatures have good low-temperature fixability. Low-temperature fixability was evaluated in a normal temperature, normal humidity environment (25.0° C./50% RH). The evaluation results are shown in Table 8.

Evaluation Standard

A: Fixing initiation temperature less than 190° C.

B: Fixing initiation temperature at least 190° C. and less than 200° C.

C: Fixing initiation temperature at least 200° C. and less than 210° C.

D: Fixing initiation temperature at least 210° C.

Evaluation of Developing Performance

The above printer was used with a process cartridge filled with the toner 1, with a fixing temperature of 200° C. An image output test was performed by printing 5,000 sheets of an E character pattern with a print percentage of 2%, 2 sheets per job, with the mode set so that the next job started after the machine was stopped temporarily between job and job. On the 5,000th sheet, a 10 mm-square solid image was printed instead of the E character pattern. Output was performed in a high-temperature, high-humidity environment (32.5° C., RH 85%) which was severe for developing performance.

The evaluation was based on the number of black spots occurring due to aggregation of the toner on the 10 mm-square solid image. The smaller the number of image defects, the better the developing performance. The evaluation results are shown in Table 8.

Evaluation Standard

A: Not more than 1 black spot

B: From 2 to 4 black spots

C: From 5 to 7 black spots

D: At least 8 black spots

Evaluation of Heat-Resistant Storage Stability 5 g samples of the toner 1 were weighed exactly, and left for 24 hours in 23° C., 60% RH environment and a 30° C., 80% RH environment. The degree of agglomeration of each of the toners after standing was measured by the "Method for Measuring Toner Agglomeration" described above. Given 100% as the agglomeration of the toner left at 23° C., 60% RH, the increase in the agglomeration of the toner left at 80% RH was used as a benchmark. A lower increase indicates good heat-resistant storage stability. The evaluation results are shown in Table 8.

Evaluation Standard

A: Agglomeration increase less than 5%

B: Agglomeration increase at least 5% and less than 10%

C: Agglomeration increase at least 10% and less than 20%

D: Agglomeration increase at least 20%

Examples 2 to 29, Comparative Examples 1 to 11

The same evaluations were performed as in Example 1 using toners 2 to 40. The evaluation results are shown Table 8.

TABLE 8

| | | Low-temperature fixability | | Developing performance | | Heat-resistant storage stability | |
|---|---|---|---|---|---|---|---|
| | Toner No. | Evaluation | Fixing initiation temperature [° C.] | Evaluation | Number of image defects | Evaluation | Agglomeration increase [%] |
| Example 1 | 1 | A | 180 | A | 0 | A | 3 |
| Example 2 | 2 | A | 180 | B | 2 | B | 7 |
| Example 3 | 3 | C | 205 | B | 2 | A | 4 |
| Example 4 | 4 | B | 195 | B | 3 | A | 4 |
| Example 5 | 5 | B | 195 | A | 0 | A | 3 |
| Example 6 | 6 | A | 180 | B | 3 | A | 4 |
| Example 7 | 7 | B | 190 | C | 6 | A | 4 |
| Example 8 | 8 | A | 185 | B | 3 | A | 4 |
| Example 9 | 9 | A | 185 | B | 3 | A | 4 |
| Example 10 | 10 | A | 185 | B | 3 | A | 3 |
| Example 11 | 11 | B | 195 | B | 4 | A | 3 |
| Example 12 | 12 | A | 185 | A | 1 | A | 3 |
| Example 13 | 13 | A | 185 | B | 3 | B | 8 |
| Example 14 | 14 | B | 195 | B | 4 | C | 12 |
| Example 15 | 15 | B | 195 | C | 6 | C | 12 |
| Example 16 | 16 | A | 185 | C | 6 | A | 3 |
| Example 17 | 17 | A | 185 | C | 7 | A | 4 |
| Example 18 | 18 | B | 195 | C | 6 | A | 3 |
| Example 19 | 19 | B | 195 | C | 6 | A | 3 |
| Example 20 | 20 | C | 200 | C | 7 | A | 4 |
| Example 21 | 21 | A | 185 | B | 3 | A | 4 |
| Example 22 | 22 | A | 185 | B | 3 | A | 4 |

TABLE 8-continued

| | Toner No. | Low-temperature fixability | | Developing performance | | Heat-resistant storage stability | |
|---|---|---|---|---|---|---|---|
| | | Evaluation | Fixing initiation temperature [° C.] | Evaluation | Number of image defects | Evaluation | Agglomeration increase [%] |
| Example 23 | 23 | A | 185 | B | 4 | A | 4 |
| Example 24 | 24 | A | 185 | C | 5 | A | 4 |
| Example 25 | 25 | A | 185 | C | 5 | A | 3 |
| Example 26 | 26 | A | 185 | C | 6 | A | 3 |
| Example 27 | 27 | A | 185 | C | 6 | B | 5 |
| Example 28 | 28 | A | 185 | C | 5 | B | 7 |
| Example 29 | 29 | A | 185 | C | 6 | B | 8 |
| Comparative Example 1 | 30 | A | 185 | D | 8 | C | 10 |
| Comparative Example 2 | 31 | A | 185 | D | 8 | C | 14 |
| Comparative Example 3 | 32 | A | 185 | D | 8 | C | 10 |
| Comparative Example 4 | 33 | D | 215 | D | 9 | A | 4 |
| Comparative Example 5 | 34 | A | 185 | D | 12 | A | 4 |
| Comparative Example 6 | 35 | D | 215 | D | 9 | A | 4 |
| Comparative Example 7 | 36 | A | 185 | A | 1 | D | 22 |
| Comparative Example 8 | 37 | A | 185 | D | 8 | A | 4 |
| Comparative Example 9 | 38 | D | 215 | D | 9 | A | 4 |
| Comparative Example 10 | 39 | D | 215 | D | 9 | A | 4 |
| Comparative Example 11 | 40 | A | 185 | D | 8 | A | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-023932, filed Feb. 14, 2018, which is hereby incorporated by reference herein in its entirety.

What is claimed is:

1. An external additive comprising:

a resin particle containing a crystalline resin and an inorganic fine particle containing a metal atom, the inorganic fine particle being embedded in the resin particle with a part of the inorganic fine particle being exposed on a surface of the resin particle, wherein a maximum endothermic peak in differential scanning calorimetry of the external additive is from 50.0 to 120.0° C. during a first temperature rise, the external additive has a shape factor SF-2 of 110 to 150 as measured in a scanning electron microscope image at a magnification of 200,000, and $$Za \geq 15 \text{ and } Za/Zb \geq 1.0$$

where $Za$ (mass %)={$dm$×(atomic weight of the metal atom)}/[{$dC$×(atomic weight of carbon)}+{$dO$×(atomic weight of oxygen)}+{$dm$×(atomic weight of the metal atom)}]×100, dm represents a concentration of the metal atom on a surface of the external additive obtained by X-ray photoelectron spectroscopy, represents a concentration of carbon atom at the surface of the external additive obtained by X-ray photoelectron spectroscopy, dO represents a concentration of oxygen atom at the surface of the external additive obtained by X-ray photoelectron spectroscopy, and $Zb$ (mass %)=(mass of the metal atom obtained from an ash content derived from the inorganic fine particle, the ash content being obtained by heating the external additive at 900° C. for 1 hour)/(mass of the external additive)×100.

2. The external additive according to claim 1, wherein the number-average particle diameter of a primary particle of the external additive according to the dynamic light scattering method is from 50 to 300 nm.

3. The external additive according to claim 1, wherein the inorganic fine particle is at least one selected from the group consisting of a silica fine particle, alumina fine particle, titania fine particle, zinc oxide fine particle, strontium titanate fine particle, calcium carbonate fine particle and cerium oxide fine particle.

4. The external additive according to claim 1, wherein the acid value of the crystalline resin is from 5.0 to 30.0 mgKOH/g.

5. The external additive according to claim 1, wherein the crystalline resin contains a crystalline polyester.

6. A toner comprising a toner particle containing a binder resin and a colorant together with an external additive on the surface of the toner particle, wherein the external additive contains the external additive according to claim 1.

7. The toner according to claim 6, wherein in a temperature T [° C.]-storage elastic modulus E' [Pa] curve obtained by powder dynamic viscoelasticity measurement of the toner, a curve of the change in the storage elastic modulus E' relative to the temperature T (dE'/dT) shows minimum values of not more than $-1.0\times10^7$ within a temperature range between the onset temperature of the dE'/dT curve and 90° C., and the minimum value at the lowest temperature end of the curve is not more than $-9.0\times10^7$.

8. A method for manufacturing the external additive according to claim 1, the external additive having a resin particle containing a crystalline resin and an inorganic fine particle being embedded in the resin particle, with part of the inorganic fine particle being exposed on the surface of the resin particle, the method comprising the steps of:

a step of co-dispersing the inorganic fine particle and the resin particle containing the crystalline resin in an aqueous medium to obtain a liquid dispersion, and a step of adjusting the pH of the resulting dispersion from a pH above 3.5 to a pH of 3.5 or less to accumulate the inorganic fine particle on the surface of the resin particle, wherein in differential scanning calorimetry of the external additive, the maximum endothermic peak temperature during the first temperature rise is from 50.0° C. 50.0 to 120.0° C.

9. The method for manufacturing an external additive according to claim 8, wherein in differential scanning calorimetry of the crystalline resin $$50.0 \leq T1 \leq 120.0,$$

$$|T2-T1| \leq 30.0, \text{ and}$$

$$T2 \leq 100.0$$

when T1 (° C.) is the onset temperature of the maximum endothermic peak during the first temperature rise and T2 (° C.) is the temperature of the liquid dispersion in the step of accumulating the inorganic fine particles on the surface of the resin particle.

10. The method for manufacturing an external additive according to claim 8, comprising a step a of preparing a crystalline resin solution 1 containing the crystalline resin dissolved in an organic solvent, a step b of preparing a crystalline resin solution 2 by adding a neutralizing agent with an acid dissociation constant pKa of at least 7.0 to the crystalline resin solution 1, and a step c in which the resin particle is obtained by adding water to the crystalline resin solution 2 to prepare a liquid dispersion A of the resin particle by phase inversion emulsification.

11. The method for manufacturing an external additive according to claim 10, wherein the acid dissociation constant pKa of the neutralizing agent is from 7.5 to 14.0.

12. The method for manufacturing an external additive according to claim 10, wherein the boiling point of the neutralizing agent is not more than 140° C.

13. The method for manufacturing an external additive according to claim 8, comprising a step d of preparing a crystalline resin solution 3 containing the crystalline resin dissolved in an organic solvent, and a step e of mixing the crystalline resin solution 3 with an aqueous medium and stirring to prepare a liquid dispersion B and obtain the resin particle, wherein either or both of the crystalline resin solution 3 and the aqueous medium contains a surfactant.

14. The method for manufacturing an external additive according to claim 8, wherein the amount of the inorganic fine particle added when co-dispersing is from 20 to 80 mass parts per 100 mass parts of the resin particle.

15. The method for manufacturing an external additive according to claim 8, wherein the hydrophobicity of the inorganic fine particle is not more than 30.0 methanol vol %.

16. The method for manufacturing an external additive according to claim 8, wherein the inorganic fine particle is at least one selected from the group consisting of a silica fine particle, alumina fine particle, titania fine particle, zinc oxide fine particle, strontium titanate fine particle, calcium carbonate fine particle and cerium oxide fine particle.

17. The method for manufacturing an external additive according to claim 8, wherein $5.0 \leq Ry/Rx \leq 100.0$ when Rx (nm) is the number-average particle diameter of a primary particle of the inorganic fine particle and Ry (nm) is the number-average particle diameter of a primary particle of the resin particle.

18. The method for manufacturing an external additive according to claim 8, wherein the acid value of the crystalline resin is 5.0 to 30.0 mgKOH/g.

19. The method for manufacturing an external additive according to claim 8, comprising a step of treating the surface of the resulting external additive with a hydrophobic agent after the step of accumulating the inorganic fine particles on the surface of the resin particle.

* * * * *